US012674221B2

(12) United States Patent
Wada et al.

(10) Patent No.: US 12,674,221 B2
(45) Date of Patent: Jul. 7, 2026

(54) HIGH-STRENGTH STEEL SHEET AND METHOD FOR MANUFACTURING SAME

(71) Applicant: JFE Steel Corporation, Tokyo (JP)

(72) Inventors: Yusuke Wada, Tokyo (JP); Hidekazu Minami, Tokyo (JP); Yuki Toji, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 169 days.

(21) Appl. No.: 18/683,349

(22) PCT Filed: Aug. 5, 2022

(86) PCT No.: PCT/JP2022/030044

§ 371 (c)(1),
(2) Date: Feb. 13, 2024

(87) PCT Pub. No.: WO2023/026819

PCT Pub. Date: Mar. 2, 2023

(65) Prior Publication Data

US 2025/0137084 A1 May 1, 2025

(30) Foreign Application Priority Data

Aug. 24, 2021 (JP) ..... 2021-136566

(51) Int. Cl.
*C22C 38/38* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ... C22C 38/001; C22C 38/002; C22C 38/005; C22C 38/008; C22C 38/02; C22C 38/04;
(Continued)

(56) References Cited

U.S. PATENT DOCUMENTS

2018/0202019 A1 7/2018 Toda et al.
2018/0258514 A1* 9/2018 Oka ..... C23C 2/40
(Continued)

FOREIGN PATENT DOCUMENTS

CN 110268083 A 9/2019
EP 3 323 906 A1 5/2018
(Continued)

OTHER PUBLICATIONS

Office Action (Request for the Submission of an Opinion) issued Oct. 17, 2025, by the Korean Intellectual Property Office in corresponding Korean Patent Application No. 10-2024-7004226 and an English translation with the Concise Statement of Relevance of the Office Action. (14 pages).
(Continued)

*Primary Examiner* — Katherine A Christy
(74) *Attorney, Agent, or Firm* — Buchanan Ingersoll & Rooney PC

(57) ABSTRACT

A high-strength steel sheet has a tensile strength of 1180 MPa or more. The high-strength steel sheet has a component composition containing C: 0.090 mass % or more and 0.390 mass % or less, Si: 0.01 mass % or more and 2.00 mass % or less, Mn: 2.00 mass % or more and 4.00 mass % or less, P: 0.100 mass % or less, S: 0.0200 mass % or less, Al: 1.000 mass % or less, N: 0.0100 mass % or less, and O: 0.0100 mass % or less, with a remaining part consisting of Fe and inevitable impurities; and a microstructure. In the microstructure, an area ratio of martensite is 70% or more, an area ratio of ferrite is 10% or less, an area ratio of retained
(Continued)

austenite is 10% or less, and a proportion of the number of martensite blocks in which metastable carbides are present to the number of martensite blocks is 2% or more.

24 Claims, 3 Drawing Sheets

(51) Int. Cl.

| | |
|---|---|
| ***C21D 8/02*** | (2026.01) |
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |
| ***C22C 38/60*** | (2006.01) |

(52) U.S. Cl.
CPC ..... *C21D 8/02* (2013.01); *C21D 8/0226* (2013.01); *C21D 8/0236* (2013.01); *C21D 8/0263* (2013.01); *C21D 8/0284* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/32* (2013.01); *C22C 38/38* (2013.01); *C22C 38/60* (2013.01); *C21D 2211/001* (2013.01); *C21D 2211/004* (2013.01); *C21D 2211/005* (2013.01); *C21D 2211/008* (2013.01); *C21D 2241/00* (2013.01)

(58) Field of Classification Search
CPC ..... C22C 38/06; C22C 38/08; C22C 38/10; C22C 38/12; C22C 38/14; C22C 38/16; C22C 38/32; C22C 38/38; C22C 38/60; C21D 2211/001; C21D 2211/005; C21D 2211/008
USPC ..... 428/610
See application file for complete search history.

(56) References Cited

U.S. PATENT DOCUMENTS

| | | | |
|---|---|---|---|
| 2020/0032364 | A1 | 1/2020 | Hirashima et al. |
| 2023/0127592 | A1 | 4/2023 | Shimotomai |

FOREIGN PATENT DOCUMENTS

| | | | |
|---|---|---|---|
| EP | 4067523 | A1 | 10/2022 |
| JP | 2015175050 | A | 10/2015 |
| JP | 2016050343 | A | 4/2016 |
| JP | 2018-188675 | A | 11/2018 |
| JP | 2020059881 | A | 4/2020 |
| KR | 10-2018-0015736 | A | 2/2018 |
| WO | 2021153393 | A1 | 8/2021 |
| WO | 2021193057 | A1 | 9/2021 |

OTHER PUBLICATIONS

International Search Report (PCT/ISA/210) with translation and Written Opinion (PCT/ISA/237) mailed on Oct. 25, 2022, by the Japanese Patent Office as the International Searching Authority for International Application No. PCT/JP2022/030044. (9 pages).
Office Action with partial translation dated Jan. 24, 2023 issued by the Japanese Patent Office in corresponding Japanese Patent Application No. 2022-576110. (4 pages).
The extended European Search Report issued Oct. 16, 2024, by the European Patent Office in corresponding European Patent Application No. 22861109.1-1103. (9 pages).
Qiao et al., "Phase transformation and microstructural control of low alloyed ultra-high strength steels", Heat Treatment of Metals, (Jan. 25, 2015), vol. 40, No. 1, pp. 12-22 with an English Abstract.
Office Action (The First Office Action) issued Apr. 1, 2026, by the State Intellectual Property Office of People's Republic of China in corresponding Chinese Patent Application No. 202280054470.9 and an English translation of the Office Action. (17 pages).

* cited by examiner

HIGH-STRENGTH STEEL SHEET AND METHOD FOR MANUFACTURING SAME

CROSS REFERENCE TO RELATED APPLICATIONS

This is the U.S. National Phase application of PCT/JP2022/030044, filed Aug. 5, 2022, which claims priority to Japanese Patent Application No. 2021-136566, filed Aug. 24, 2021, the disclosures of each of these applications being incorporated herein by reference in their entireties for all purposes.

FIELD OF THE INVENTION

The present invention relates to a high-strength steel sheet and a method for manufacturing the same.

BACKGROUND OF THE INVENTION

In order to achieve both reduction of $CO_2$ emission by reducing the weight of vehicles and improvement in crashworthiness by reducing the weight of automobile bodies, strengthening of steel sheets for automobiles has advanced, and new legal restrictions have been successively introduced. Therefore, for the purpose of increasing the strength of the automobile bodies, high-strength steel sheets having a tensile strength (TS) of 1180 MPa or higher (for example, Patent Literature 1) have been increasingly applied to main structural parts constituting the framework of an automobile cabin.

PATENT LITERATURE

Patent Literature 1: JP 2016-50343 A

SUMMARY OF THE INVENTION

High-strength steel sheets used for reinforcing parts and frame structural parts of automobiles are required to have excellent part strength (large impact absorption energy during collision). This can be achieved by increasing the yield strength (YS) of the steel sheet or increasing the yield ratio of the steel sheet (YR=yield strength YS/tensile strength TS).

Parts such as a crash box have blanked edges and bent portions. Therefore, the steel sheet used for these parts is required to have good stretch flangeability and bendability.

In a part using a high-strength steel sheet having a tensile strength of 1180 MPa or more, so-called delayed fracture may occur due to intrusion of hydrogen into the part.

For the steel sheets for automobiles, a stress is applied thereto during pressing or assembling, and thereafter, there is a risk that hydrogen enters from the environment, so that good delayed fracture resistance is required.

In order to increase the percentage of application of the high-strength steel sheet to the automobile part, it is desired to comprehensively satisfy the above-described characteristics.

The present invention has been made in view of the above points, and an object of the present invention is to provide a high-strength steel sheet having a tensile strength of 1180 MPa or more and excellent in part strength, stretch flangeability, bendability, and delayed fracture resistance.

As a result of intensive studies, the present inventors have found that the above object is achieved by adopting the following configuration, and have completed the present invention.

That is, the present invention according to exemplary embodiments provides the following [1] to [14].

[1] A high-strength steel sheet comprising a steel sheet, the steel sheet having: a component composition containing
- C in an amount of 0.090 mass % or more and 0.390 mass % or less,
- Si in an amount of 0.01 mass % or more and 2.00 mass % or less,
- Mn in an amount of 2.00 mass % or more and 4.00 mass % or less,
- P in an amount of 0.100 mass % or less,
- S in an amount of 0.0200 mass % or less,
- Al in an amount of 1.000 mass % or less,
- N in an amount of 0.0100 mass % or less, and
- O in an amount of 0.0100 mass % or less, with a remaining part consisting of Fe and inevitable impurities; and a microstructure, wherein in the microstructure,
- an area ratio of martensite is 70% or more,
- an area ratio of ferrite is 10% or less,
- an area ratio of retained austenite is 10% or less, and
- a proportion of the number of martensite blocks in which metastable carbides are present to the number of martensite blocks is 2% or more.

[2] The high-strength steel sheet according to [1] above, wherein a number density of the metastable carbides in the martensite blocks in which the metastable carbides are present is $1\times10^6$ metastable carbides/$mm^2$ or more.

[3] The high-strength steel sheet according to [1] or [2] above,
wherein the component composition further contains at least one element selected from the group consisting of
- Ti in an amount of 0.200 mass % or less,
- Nb in an amount of 0.200 mass % or less,
- V in an amount of 0.200 mass % or less,
- Ta in an amount of 0.10 mass % or less,
- W in an amount of 0.10 mass % or less,
- B in an amount of 0.0100 mass % or less,
- Cr in an amount of 1.00 mass % or less,
- Mo in an amount of 1.00 mass % or less,
- Ni in an amount of 1.00 mass % or less,
- Co in an amount of 0.010 mass % or less,
- Cu in an amount of 1.00 mass % or less,
- Sn in an amount of 0.200 mass % or less,
- Sb in an amount of 0.200 mass % or less,
- Ca in an amount of 0.0100 mass % or less,
- Mg in an amount of 0.0100 mass % or less,
- REM in an amount of 0.0100 mass % or less,
- Zr in an amount of 0.100 mass % or less,
- Te in an amount of 0.100 mass % or less,
- Hf in an amount of 0.10 mass % or less, and
- Bi in an amount of 0.200 mass % or less.

[4] The high-strength steel sheet according to any one of to [3] above,
wherein the steel sheet includes a soft layer as a surface layer,
the surface layer is a portion from a surface of the steel sheet to 200 μm in a sheet thickness direction, and
the soft layer is a portion having Vickers hardness of 85% or less with respect to Vickers hardness at a ¼ position of a sheet thickness of the steel sheet.

[5] The high-strength steel sheet according to [4] above, wherein when nano-hardness at a ¼ position in depth in the sheet thickness direction of the soft layer is measured at 300 or more points within a range of 50 μm×50 μm, a proportion r of measurement points having nano-hardness of 7.0 GPa or more to a total number of measurement points is 0.10 or less.

[6] The high-strength steel sheet according to [4] or [5], wherein a standard deviation $\sigma_A$ of nano-hardness at a ¼ position in depth in the sheet thickness direction of the soft layer is 1.8 GPa or less, and a standard deviation $\sigma_B$ of nano-hardness at a ½ position in depth in the sheet thickness direction of the soft layer is 2.2 GPa or less.

[7] The high-strength steel sheet according to any one of [1] to [6] above, further comprising a metal plated layer as a pre-annealing plated layer on a surface of the steel sheet.

[5] The high-strength steel sheet according to any one of [1] to [6] above, further comprising a plated layer on a surface of the steel sheet.

[9] The high-strength steel sheet according to [7] above, further comprising a plated layer on a surface of the metal plated layer.

[10] A method for manufacturing the high-strength steel sheet according to any one of [1] to [3] above, the method comprising:

subjecting a steel slab having the component composition according to [1] or [3] above to hot rolling, pickling, and cold rolling to obtain a cold-rolled steel sheet; and subjecting the cold-rolled steel sheet to annealing and post-heating, wherein in the annealing, the cold-rolled steel sheet is subjected to heating at a heating temperature of 800° C. or higher, and then to cooling to a cooling stop temperature of 150° C. or lower, in the cooling, a staying time t1 in a temperature range T1 of higher than Ms ° C. and 700° C. or lower is 1000 s or less, a first average cooling rate v1 in a temperature range T2 of (Ms-80) ° C. or higher and Ms ° C. or lower is 1.0° C./s or more and 40.0° C./s or less, and a second average cooling rate v2 in a temperature range T3 of 150° C. or higher and lower than (Ms-80) ° C. is 0.3° C./s or more and less than the first average cooling rate v1, and the post-heating is performed under a condition that a temperature X that is a maximum end-point temperature and a retention time Y at the temperature X-10° C. or higher satisfy Formula 1:

$$8000 \leq (273 + X) \times (20 + \mathrm{Log}(Y/3600)) \leq 12000, \quad \text{Formula 1}$$

where a unit of the temperature X is ° C., and a unit of the retention time Y is s.

[11] The method according to [10] above, wherein the temperature X satisfies Formula 2:

$$100 \leq X \leq 400. \quad \text{Formula 2}$$

[12] The method according to [10] or [11] above, wherein in the annealing, heating at the heating temperature is performed in an atmosphere having a dew point of −30° C. or higher to form a soft layer on a surface layer of the cold-rolled steel sheet, the surface layer is a portion from a surface of the cold-rolled steel sheet to 200 μm in a sheet thickness direction, and the soft layer is a portion having Vickers hardness of 85% or less with respect to Vickers hardness at a ¼ position of a sheet thickness of the cold-rolled steel sheet.

[13] The method according to any one of [10] to [12] above, wherein before being subjected to the annealing, the cold-rolled steel sheet is subjected to a metal plating treatment to form a metal plated layer as a pre-annealing plated layer on a surface of the cold-rolled steel sheet.

[14] The method according to any one of [10] to [13] above, wherein in the annealing, the cold-rolled steel sheet is subjected to a plating treatment to form a plated layer.

The present invention can provide a high-strength steel sheet having a tensile strength of 1180 MPa or more and excellent in part strength, stretch flangeability, bendability, and delayed fracture resistance.

DETAILED DESCRIPTION OF EMBODIMENTS OF THE INVENTION

[High-Strength Steel Sheet]

Figure 1:
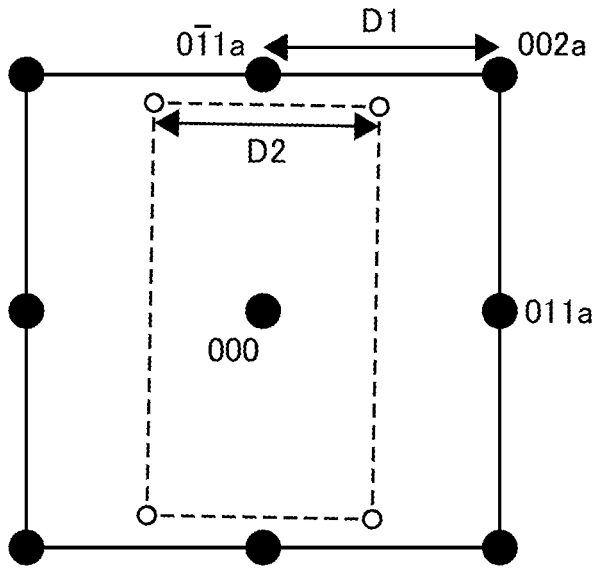
FIG. 1 is an example of an electron diffraction pattern of martensite in which carbides are present.

A high-strength steel sheet of the present invention includes a steel sheet (base steel sheet), and the steel sheet has a component composition and a microstructure to be described later.

The high-strength steel sheet according to embodiments of the present invention has a tensile strength of 1180 MPa or more and excellent in part strength, stretch flangeability, bendability, and delayed fracture resistance.

The high-strength steel sheet of the present invention is applied to, for example, a structural member of an automobile, so that the fuel efficiency of the automobile can be improved due to reduction of the weight of an automobile body, and the high-strength steel sheet has an extremely large industrial utility value.

The term "high-strength" means that tensile strength (TS) obtained by a tensile test to be described later is 1180 MPa or more.

The term "excellent in part strength" means that a yield ratio (YR) obtained by a tensile test to be described later is 65% or more.

The term "excellent in stretch flangeability" means that a hole expansion ratio (λ) obtained by a hole expansion test to be described later is 30% or more.

The term "excellent in bendability" means a case where none of five test pieces is cracked in a bending test to be described later.

The term "excellent in delayed fracture resistance" means that, in a delayed fracture test to be described later, cracking is not confirmed at an elapsed time of 48 hours when TS is 1180 MPa or more and less than 1700 MPa, and at an elapsed time of 24 hours when TS is 1700 MPa or more.

<Steel Sheet>

First, the steel sheet (base steel sheet) constituting the high-strength steel sheet according to embodiments of the present invention will be described.

The steel sheet is, for example, a cold-rolled steel sheet having been subjected to post-heating to be described later.

The sheet thickness of the steel sheet is not particularly limited, and is usually 0.3 mm or more and 2.8 mm or less.

<<Component Composition>>

The component composition of the steel sheet (hereinafter, also referred to as "component composition of the present invention" for convenience) will be described.

"%" in the component composition of the present invention means "mass %" unless otherwise specified.

(C: 0.090% or More and 0.390% or Less)

C is one of the important fundamental components of steel and, in particular in the present invention, affects the area ratios of martensite and ferrite.

When the C content is too small, the area ratio of martensite decreases, which makes it difficult to achieve TS of 1180 MPa or more. Therefore, the C content is 0.090% or more, preferably 0.100% or more, and more preferably 0.110% or more.

Meanwhile, when the C content is too large, retained austenite excessively increases, so that the hardness of martensite generated from the retained austenite during punching greatly increases. As a result, crack development during hole expansion is promoted, so that a hole expansion ratio decreases, and stretch flangeability decreases. Bendability is also deteriorated. Therefore, the C content is 0.390% or less, preferably 0.360% or less, and more preferably 0.350% or less.

(Si: 0.01% or More and 2.00% or Less)

Si suppresses precipitation of cementite in martensite and strengthens solid solution to increase the strength of the steel sheet. In order to obtain this effect, the Si content is 0.01% or more, preferably 0.20% or more, and more preferably 0.30% or more.

Meanwhile, when the Si content is too large, the area ratio of ferrite becomes excessive, so that generation of voids during punching and hole expansion at the interface between ferrite and martensite increases. As a result, a hole expansion ratio decreases, and stretch flangeability decreases. Part strength and bendability are deteriorated. Therefore, the Si content is 2.00% or less, preferably 1.50% or less, and more preferably 1.30% or less.

(Mn: 2.00% or More and 4.00% or Less)

Mn is one of the important fundamental components of steel and, in particular in the present invention, affects the area ratio of martensite.

When the Mn content is too small, the area ratio of martensite decreases, which makes it difficult to achieve TS of 1180 MPa or more. Therefore, the Mn content is 2.00% or more, preferably 2.20% or more, and more preferably 2.50% or more.

Meanwhile, when the Mn content is too large, austenite is stabilized, and retained austenite excessively increases, so that the hardness of martensite generated from the retained austenite during punching greatly increases. As a result, crack development during hole expansion is promoted, so that a hole expansion ratio decreases, and stretch flangeability decreases. Therefore, the Mn content is 4.00% or less, preferably 3.80% or less, and more preferably 3.60% or less.

(P: 0.100% or Less)

P segregates at prior austenite grain boundaries to embrittle the grain boundaries, so that the ultimate deformability of the steel sheet is reduced. As a result, a hole expansion ratio decreases, and stretch flangeability decreases. Bendability is also deteriorated. Therefore, the P content is 0.100% or less, preferably 0.070% or less, more preferably 0.050% or less, and still more preferably 0.020% or less.

The lower limit of the P content is not particularly limited. However, P is a solid solution strengthening element and increases the strength of the steel sheet. Therefore, the P content is preferably 0.001% or more, and more preferably 0.002% or more.

(S: 0.0200% or Less)

S is present as a sulfide and reduces the ultimate deformability of the steel sheet. As a result, a hole expansion ratio decreases, and stretch flangeability decreases. Bendability is also deteriorated. Therefore, the S content is 0.0200% or less, preferably 0.0100% or less, more preferably 0.0050% or less, and still more preferably 0.0020% or less.

The lower limit of the S content is not particularly limited, but is preferably 0.0001% from the viewpoint of restrictions on production technology.

(Al: 1.000% or Less)

Al provides sufficient deoxidation and reduces inclusions in steel.

However, when the Al content is too large, a large amount of ferrite is generated, a hole expansion ratio decreases, and stretch flangeability decreases. Therefore, the Al content is 1.000% or less, preferably 0.500% or less, and more preferably 0.100% or less.

Meanwhile, in order to stably perform deoxidation, the Al content is preferably 0.010% or more, more preferably 0.015% or more, and still more preferably 0.020% or more.

(N: 0.0100% or Less)

N is present as a nitride and reduces the ultimate deformability of the steel sheet. As a result, a hole expansion ratio decreases, and stretch flangeability decreases. Bendability is also deteriorated. Therefore, the N content is 0.0100% or less, preferably 0.0070% or less, and more preferably 0.0050% or less.

The lower limit of the N content is not particularly limited, but is preferably 0.0001% from the viewpoint of restrictions on production technology.

(O: 0.0100% or Less)

O is present as an oxide and reduces the ultimate deformability of the steel sheet. As a result, a hole expansion ratio decreases, and stretch flangeability decreases. Bendability is also deteriorated. Therefore, the O content is 0.0100% or less, preferably 0.0050% or less, more preferably 0.0030% or less, and still more preferably 0.0020% or less.

The lower limit of the 0 content is not particularly limited, but is preferably 0.0001% from the viewpoint of restrictions on production technology.

(Other Elements)

The component composition of the present invention may further contain at least one element selected from the group consisting of elements to be described later in terms of mass %.

((Ti, Nb and V: Each 0.200% or Less))

The contents of Ti, Nb, and V are each preferably 0.200% or less, more preferably 0.100% or less, and still more preferably 0.080% or less. When the content of each element is within this range, a large amount of coarse precipitates or inclusions are not generated, and the ultimate deformability of the steel sheet is not deteriorated, so that stretch flangeability (hole expansion ratio) is more excellent. Bendability is also more excellent.

Meanwhile, the lower limit of the contents of Ti, Nb, and V is not particularly limited. However, Ti, Nb, and V form fine carbides, nitrides, or carbonitrides during hot rolling or annealing to be described later to increase the strength of the steel sheet. Therefore, when Ti, Nb, and V are added, the contents of Ti, Nb, and V are each preferably 0.001% or more, more preferably 0.005% or more, and still more preferably 0.010% or more, from the viewpoint of obtaining the addition effects of these elements.

((Ta and W: Each 0.10% or Less))

The contents of Ta and W are each preferably 0.10% or less, more preferably 0.08% or less, and still more preferably 0.04% or less. When the content of each element is within this range, a large amount of coarse precipitates or inclusions are not generated, and the ultimate deformability of the steel sheet is not deteriorated, so that stretch flangeability (hole expansion ratio) is more excellent. Bendability is also more excellent.

Meanwhile, the lower limit of the contents of Ta and W is not particularly limited. However, Ta and W form fine carbides, nitrides, or carbonitrides during hot rolling or annealing to be described later to increase the strength of the steel sheet. Therefore, when Ta and W are added, the contents of Ta and W are each preferably 0.01% or more from the viewpoint of obtaining the addition effects of these elements.

((B: 0.0100% or Less))

The B content is preferably 0.0100% or less, more preferably 0.0080% or less, and still more preferably 0.0050% or less. When the B content is within this range, cracking is not generated inside the steel sheet during hot rolling to be described later, and the ultimate deformability of the steel sheet is not deteriorated, so that stretch flangeability (hole expansion ratio) is more excellent. Bendability is also more excellent.

Meanwhile, the lower limit of the B content is not particularly limited. However, B segregates at austenite grain boundaries during annealing to be described later to improve hardenability. Therefore, when B is added, the B content is preferably 0.0003% or more, more preferably 0.0005% or more, and still more preferably 0.0010% or more, from the viewpoint of obtaining the addition effect of B.

((Cr, Mo and Ni: Each 1.00% or Less))

Cr, Mo, and Ni are each preferably 1.00% or less, more preferably 0.90% or less, and still more preferably 0.80% or less. When the content of each element is within this range, coarse precipitates or inclusions do not increase, and the ultimate deformability of the steel sheet is not deteriorated, so that stretch flangeability (hole expansion ratio) is more excellent. Bendability is also more excellent.

Meanwhile, the lower limit of the contents of Cr, Mo, and Ni is not particularly limited. However, Cr, Mo, and Ni improve hardenability. Therefore, when Cr, Mo, and Ni are added, the contents of Cr, Mo, and Ni are each preferably 0.01% or more, more preferably 0.02% or more, and still more preferably 0.03% or more, from the viewpoint of obtaining the addition effects of these elements.

((Co: 0.010% or Less))

The Co content is preferably 0.010% or less, more preferably 0.008% or less, and still more preferably 0.006% or less. When the Co content is within this range, coarse precipitates or inclusions do not increase, and the ultimate deformability of the steel sheet is not deteriorated, so that stretch flangeability (hole expansion ratio) is more excellent. Bendability is also more excellent.

Meanwhile, the lower limit of the Co content is not particularly limited. However, Co improves hardenability. Therefore, when Co is added, the Co content is preferably 0.001% or more, more preferably 0.002% or more, and still more preferably 0.004% or more, from the viewpoint of obtaining the addition effect of Co.

((Cu: 1.00% or Less))

The Cu content is preferably 1.00% or less, more preferably 0.80% or less, and still more preferably 0.30% or less. When the Cu content is within this range, coarse precipitates or inclusions do not increase, and the ultimate deformability of the steel sheet is not deteriorated, so that stretch flangeability (hole expansion ratio) is more excellent. Bendability is also more excellent.

Meanwhile, the lower limit of the Cu content is not particularly limited. However, Cu improves hardenability. Therefore, when Cu is added, the Cu content is preferably 0.01% or more, more preferably 0.03% or more, and still more preferably 0.05% or more, from the viewpoint of obtaining the addition effect of Cu.

((Sn: 0.200% or Less))

The Sn content is preferably 0.200% or less, more preferably 0.100% or less, and still more preferably 0.050% or less. When the Sn content is within this range, cracking is not generated inside the steel sheet during casting or hot rolling to be described later, and the ultimate deformability of the steel sheet is not deteriorated, so that stretch flangeability (hole expansion ratio) is more excellent. Bendability is also more excellent.

Meanwhile, the lower limit of the Sn content is not particularly limited. However, Sn improves hardenability. Therefore, when Sn is added, the Sn content is preferably 0.001% or more, more preferably 0.004% or more, and still more preferably 0.008% or more, from the viewpoint of obtaining the addition effect of Sn.

((Sb: 0.200% or Less))

The Sb content is preferably 0.200% or less, more preferably 0.100% or less, and still more preferably 0.050% or less. When the Sb content is within this range, coarse precipitates or inclusions do not increase, and the ultimate deformability of the steel sheet is not deteriorated, so that stretch flangeability (hole expansion ratio) is more excellent. Bendability is also more excellent.

Meanwhile, the lower limit of the Sb content is not particularly limited. However, Sb controls a surface layer softening thickness to enable strength adjustment. Therefore, when Sb is added, the Sb content is preferably 0.001% or more, more preferably 0.003% or more, and still more preferably 0.007% or more, from the viewpoint of obtaining the addition effect of Sb.

((Ca, Mg, and REM: Each 0.0100% or Less))

The contents of Ca, Mg, and REM (rare earth metal) are each preferably 0.0100% or less, more preferably 0.0050% or less, and still more preferably 0.0030% or less. When the content of each element is within this range, coarse precipitates or inclusions do not increase, and the ultimate deformability of the steel sheet is not deteriorated, so that stretch flangeability (hole expansion ratio) is more excellent. Bendability is also more excellent.

Meanwhile, the lower limit of the contents of Ca, Mg, and REM is not particularly limited. However, Ca, Mg, and REM spheroidize the shapes of nitrides and sulfides to improve the ultimate deformability of the steel sheet. Therefore, when Ca, Mg, and REM are added, the contents of Ca, Mg, and REM are each preferably 0.0002% or more, more preferably 0.0005% or more, and still more preferably 0.0010% or more, from the viewpoint of obtaining the addition effects of these elements.

((Zr and Te: Each 0.100% or Less))

The contents of Zr and Te are each preferably 0.100% or less, more preferably 0.080% or less, and still more preferably 0.050% or less. When the content of each element is within this range, coarse precipitates or inclusions do not increase, and the ultimate deformability of the steel sheet is not deteriorated, so that stretch flangeability (hole expansion ratio) is more excellent. Bendability is also more excellent.

Meanwhile, the lower limit of the contents of Zr and Te is not particularly limited. However, Zr and Te spheroidize the shapes of nitrides and sulfides to improve the ultimate deformability of the steel sheet. Therefore, when Zr and Te are added, the contents of Zr and Te are each preferably 0.001% or more, more preferably 0.003% or more, and still more preferably 0.007% or more, from the viewpoint of obtaining the addition effects of these elements.

((Hf: 0.10% or Less))

The Hf content is preferably 0.10% or less, more preferably 0.08% or less, and still more preferably 0.05% or less. When the Hf content is within this range, coarse precipitates or inclusions do not increase, and the ultimate deformability of the steel sheet is not deteriorated, so that stretch flangeability (hole expansion ratio) is more excellent. Bendability is also more excellent.

Meanwhile, the lower limit of the Hf content is not particularly limited. However, Hf spheroidizes the shapes of nitrides and sulfides to improve the ultimate deformability of the steel sheet. Therefore, when Hf is added, the Hf content is preferably 0.01% or more, and more preferably 0.02% or more, from the viewpoint of obtaining the addition effect of Hf.

((Bi: 0.200% or Less))

The Bi content is preferably 0.200% or less, more preferably 0.100% or less, and still more preferably 0.030% or less. When the Bi content is within this range, coarse precipitates or inclusions do not increase, and the ultimate deformability of the steel sheet is not deteriorated, so that stretch flangeability (hole expansion ratio) is more excellent. Bendability is also more excellent.

Meanwhile, the lower limit of the Bi content is not particularly limited. However, Bi is an element that reduces segregation. Therefore, when Bi is added, the Bi content is preferably 0.001% or more, more preferably 0.002% or more, and still more preferably 0.004% or more, from the viewpoint of obtaining the addition effect of Bi.

(Remaining Part)

The remaining part in the component composition of the present invention consists of Fe and inevitable impurities.

For Ti, Nb, V, Ta, W, B, Cr, Mo, Ni, Co, Cu, Sn, Sb, Ca, Mg, REM, Zr, Te, Hf, and Bi described above, when the content of each element is less than the lower limit value of the preferred range described above, the effect of the present invention is not impaired, so that the element is treated as an inevitable impurity.

<<Microstructure>>

Next, the microstructure of the steel sheet (hereinafter, also referred to as "microstructure according to embodiments of the present invention" for convenience) will be described.

(Area Ratio of Martensite: 70% or More)

TS of 1180 MPa or more can be achieved by using martensite as a main phase. Therefore, the area ratio of martensite is 70% or more, preferably 75% or more, more preferably 80% or more, and still more preferably 85% or more.

The upper limit of the area ratio is not particularly limited, and even when the area ratio of martensite is 100%, this effect is obtained.

The martensite includes lower bainite, martensite self-tempered during cooling performed in annealing to be described later, and martensite tempered by post-heating to be described later, and the like.

The observation position of martensite is a ¼ position of the sheet thickness of the steel sheet as described later.

(Area Ratio of Ferrite: 10% or Less)

By reducing the amount of ferrite, good stretch flangeability and bendability are obtained. Therefore, the area ratio of the ferrite is 10% or less, preferably 8% or less, more preferably 5% or less, and still more preferably 3% or less.

The lower limit of the area ratio is not particularly limited, and even when the area ratio of ferrite is 0%, this effect is obtained.

The ferrite includes allotriomorph ferrite, idiomorph ferrite, widmanstaetten ferrite, and upper bainite and the like.

The observation position of ferrite is a ¼ position of the sheet thickness of the steel sheet as described later.

A method for measuring the area ratios of martensite and ferrite is as follows.

First, a sample is cut out from a steel sheet so that a sheet thickness cross section (L cross section at a ¼ position of a sheet thickness) parallel to the rolling direction of the steel sheet is an observation surface. The observation surface of the sample is mirror-polished using a diamond paste, then subjected to finish polishing using colloidal silica, and further etched using 1 vol % nital, thereby exhibiting a structure.

Next, the observation surface of the sample is observed at a magnification of 3000 times using a scanning electron microscope (SEM) under the condition of an acceleration voltage of 10 kV, and SEM images for three fields are obtained.

The area ratio of each structure is calculated from the obtained SEM images using Adobe Photoshop (manufactured by Adobe Systems Incorporated). Specifically, a value obtained by dividing the area of each structure by a measurement area is taken as the area ratio of each structure. The area ratio of each structure is calculated for three fields, and the average value thereof is taken as the area ratio of each structure.

In the SEM image, ferrite is a gray flat structure, and martensite is a structure having a hierarchical constitution having fine irregularities therein. Both ferrite and martensite can be distinguished from each other.

(Area Ratio of Residual Austenite: 10% or Less)

By reducing the amount of retained austenite, good part strength and stretch flangeability are obtained. Therefore, the area ratio of retained austenite is 10% or less, preferably 8% or less, more preferably 5% or less, and still more preferably 4% or less.

The lower limit of the area ratio is not particularly limited, and even when the area ratio of retained austenite is 0%, this effect is obtained.

A method for measuring the area ratio of retained austenite is as follows.

First, a steel sheet is ground so that the ¼ position of the sheet thickness of the steel sheet (a position corresponding to ¼ of the sheet thickness in a depth direction from the surface of the steel sheet) is a measurement surface, and then the steel sheet is further chemically polished by 0.1 mm to obtain a sample.

For the measurement surface of the sample, the integrated reflection intensities of the (200) plane, (220) plane, and (311) plane of fcc iron (austenite), and the (200) plane, (211) plane, and (220) plane of bcc iron are measured using a Kα radiation source of Co by an X-ray diffractometer.

The intensity ratio of the integrated reflection intensity of each surface of the fcc iron to the integrated reflection intensity of each surface of the bcc iron is obtained. The average value of the nine intensity ratios is taken as the volume ratio of retained austenite.

The volume ratio of retained austenite is regarded as the area ratio of retained austenite.

(Proportion of Number of Martensite Blocks in which Metastable Carbides are Present to Number of Martensite Blocks: 2% or More)

Metastable carbides precipitated in martensite blocks improve delayed fracture resistance while maintaining excellent part strength, bendability, and stretch flangeability.

In order to obtain this effect, the proportion of the number of martensite blocks in which metastable carbides are present to the number of martensite blocks (also referred to as "proportion p") is 2% or more, preferably 5% or more, more preferably 10% or more, still more preferably 20% or more, and particularly preferably 30% or more.

The upper limit of the proportion p is not particularly limited, and may be 100%.

The metastable carbide is a metastable carbide precipitated in the process of tempering martensite.

The metastable carbide is, for example, an Fe carbide (iron-based carbide) other than cementite, and examples thereof include at least one carbide selected from the group consisting of an epsilon (ε) carbide, an eta (η) carbide, and a chi (χ) carbide.

A method for measuring the proportion (proportion p) of the number of martensite blocks in which metastable carbides are present to the number of martensite blocks is as follows.

First, a steel sheet is ground so that the ¼ position of the sheet thickness of the steel sheet (a position corresponding to ¼ of the sheet thickness in a depth direction from the surface of the steel sheet) is an observation surface, and then electropolished to prepare a sample. The observation surface of the prepared sample is observed using a transmission electron microscope (TEM) under the condition of an acceleration voltage of 200 kV. Since the dislocation density of martensite is significantly higher than those of ferrite and retained austenite, martensite can be distinguished from ferrite and retained austenite and identified in the observation field by observing the contrast of strain in the bright field image of TEM.

The martensite block is one of constituent units of martensite having a hierarchical constitution, and is a group of laths having the same crystal habit plane and the same crystal orientation. In the bright field image of TEM, a diffraction contrast differs for each block in martensite, so that the martensite block can be distinguished from other constituent units such as packets and laths, and can be identified.

When an electron beam is incident from the [100] orientation of the martensite block, an electron diffraction pattern of parent phase martensite is obtained. Adjacent martensite blocks are distinguished from each other because the martensite blocks have different crystal orientations with a block boundary interposed therebetween, and thus different contrasts in the bright field image.

FIG. 1 is an example of an electron diffraction pattern of martensite in which a carbide is present.

When a carbide is present in the observed single martensite block, the electron diffraction pattern of the carbide is obtained in addition to the electron diffraction pattern of parent phase martensite (a) as illustrated in FIG. 1.

In FIG. 1, black circles indicate the electron diffraction spots of parent phase martensite when an electron beam is incident from [100] orientation, and white circles indicate the electron diffraction spots of a carbide.

From a distance D1 between the electron diffraction spots of the parent phase martensite and a distance D2 between the electron diffraction spots of the carbide in FIG. 1, a ratio $d_c/d_m$ between the plane spacing $d_e$ of the carbide and the plane spacing $d_m$ of the parent phase martensite is calculated using the following Formula 3.

$$d_e/d_m = D1/D2 \quad \text{Formula 3:}$$

For the observed martensite block, when the ratio $d_e/d_m$ of the plane spacing $d_e$ of the carbide to the plane spacing $d_m$ of the parent phase martensite is 1.020 or more and 1.150 or less, the martensite block is defined as a martensite block in which metastable carbides are present.

That is, "proportion of the number of martensite blocks in which metastable carbides are present to the number of martensite blocks" can be paraphrased as "proportion of the number of martensite blocks having a ratio $d_c/d_m$ of 1.020 or more and 1.150 or less to the number of martensite blocks".

The distance D1 between the electron diffraction spots of the parent martensite is an unchanged value, but the distance D2 between the electron diffraction spots of the carbide changes in value depending on the carbide.

For example, when the carbide is cementite, the distance D2 is equal to the distance D1. Therefore, the value of the ratio $d_c/d_m$ is 1 (D1/D2=$d_e/d_m$=1).

Meanwhile, the distance D2 of a metastable carbide (such as ε carbide) is shorter than that of cementite, so that the ratio $d_c/d_m$ (=D1/D2) value is larger than 1. Therefore, the lower limit value of the ratio $d_c/d_m$ when a metastable carbide is present is "1.020".

The upper limit of the ratio $d_e/d_m$ is set as "1.150" based on the distance D2 of the ε carbide.

The metastable carbides may be present inside the martensite block or may be present at a boundary portion such as a block boundary, but are preferably present inside the martensite block.

50 martensite blocks are observed. The number of martensite blocks in which metastable carbides are present is divided by the number of observed martensite blocks, and further multiplied by 100 to obtain the result (=(the number of martensite blocks in which metastable carbides are present/50)×100). The obtained value is taken as a proportion (proportion p) [%] of the number of martensite blocks in which metastable carbides are present to the number of martensite blocks.

(Number Density of Metastable Carbides in Martensite Blocks in which Metastable Carbides are Present: $1\times10^6$ Metastable Carbides/$Mm^2$ or More)

The number density of the metastable carbides in the martensite blocks is preferably high because the delayed fracture resistance is more excellent. The reason thereof is probably that when the number density of the metastable carbides is higher, the amount of hydrogen trap becomes larger.

Specifically, the number density (also referred to as "number density n") of the metastable carbides in the martensite blocks in which the metastable carbides are present is preferably $1\times10^6$ metastable carbides/mm$^2$ or more, more preferably $10\times10^6$ metastable carbides/mm$^2$ or more, and still more preferably $100\times10^6$ metastable carbides/mm$^2$ or more.

The upper limit of the number density n is not particularly limited, and is, for example, $10{,}000{,}000\times10^6$ metastable carbides/mm$^2$, preferably $1{,}000{,}000\times10^6$ metastable carbides/mm$^2$, more preferably $100{,}000\times10^6$ metastable carbides/mm$^2$, and still more preferably $10{,}000\times10^6$ metastable carbides/mm$^2$.

The number density (number density n) of the metastable carbides in the martensite blocks in which the metastable carbides are present is determined as follows.

In the above-described measurement of the proportion p using the TEM, a selected area electron diffraction pattern is acquired in a single martensite block in which the metastable carbides are present, and a dark field image is obtained using electron diffraction spots obtained from the metastable carbides. In the dark field image, the metastable carbides exhibit a white contrast.

A region of 300 nm×300 nm is photographed inside a single martensite block, and the number of the metastable carbides is counted. Adjacent martensite blocks with a block boundary interposed therebetween may be present in the region of 300 nm×300 nm.

The area of the martensite blocks in which the metastable carbides are present is defined as the area of a single martensite block from which the selected area electron diffraction pattern is obtained. Adjacent martensite blocks are distinguished from each other because the martensite blocks have different crystal orientations with a block boundary interposed therebetween, and thus different contrasts in the bright field image.

The above measurement is performed for three fields, and a value obtained by dividing the number of the metastable carbides by the area of the martensite blocks in which the metastable carbides are present (=the number of the metastable carbides/the area of the martensite blocks in which the metastable carbides are present) is determined for three fields. The average value thereof is taken as the number density (number density n) of the metastable carbides in the martensite blocks in which the metastable carbides are present.

(Equivalent Circle Diameter of Metastable Carbide)

As the average value of the equivalent circle diameters of the metastable carbides in the martensite blocks is smaller, hydrogen trapping ability is enhanced or dislocation migration contributing to delayed fracture is suppressed, so that delayed fracture resistance is more excellent.

Therefore, the average value of the equivalent circle diameters of the metastable carbides in the martensite blocks is preferably 20 nm or less, and more preferably 5 nm or less.

The average value of the equivalent circle diameters of the metastable carbides in the martensite blocks is determined as follows.

In the above-described measurement of the proportion p using the TEM, a selected area electron diffraction pattern is acquired in a single martensite block in which the metastable carbides are present, and a dark field image is obtained using electron diffraction spots obtained from the metastable carbides. In the dark field image, the metastable carbides exhibit a white contrast.

Dark field images in the region of 300 nm×300 nm are photographed inside a single martensite block and image processing is performed to obtain a binarized image so that the metastable carbides can be distinguished. The equivalent circle diameter is obtained for each of all metastable carbide particles by subjecting the binarized image to particle analysis. When the metastable carbides overlap each other in the dark field image, the binarized image is subjected to division using the Watershed method.

The equivalent circle diameter is determined for each of all the metastable carbides present in the region of 300 nm×300 nm (for three fields). The average value of the equivalent circle diameters for three fields is determined, and this is taken as the average value of the equivalent circle diameters of the metastable carbides in the martensite blocks.

(Remaining Structure)

The microstructure according to embodiments of the present invention may have a structure (remaining structure) other than the above-described martensite, ferrite, and retained austenite.

However, the area ratio of the remaining structure is preferably 3% or less because the effect of the present invention is not impaired.

The remaining structure may be, for example, pearlite; carbides such as cementite precipitated in ferrite; alloy carbonitrides precipitated in ferrite; and structures known as other steel sheet structures; and the like.

Metastable carbides precipitated in martensite and iron-based carbides such as cementite precipitated in martensite are not included in the remaining structure.

<<Soft Layer>>

The steel sheet (base steel sheet) constituting the high-strength steel sheet of the present invention preferably includes a soft layer on a surface layer thereof.

The soft layer contributes to suppression of development of bending and cracking during press forming and collision, thus leading to more excellent bendability and also excellent fracture resistance during collision.

The surface layer is a portion from the surface of the steel sheet (cold-rolled steel sheet) to 200 μm in the sheet thickness direction.

The soft layer is a decarburized layer, and more specifically, is a portion where Vickers hardness is 85% or less with respect to Vickers hardness at a ¼ position of the sheet thickness of the steel sheet (cold-rolled steel sheet).

The Vickers hardness at the ¼ position of the sheet thickness of the steel sheet means the Vickers hardness of the cross section (plane parallel to the surface of the steel sheet) at the ¼ position of the sheet thickness of the steel sheet (position corresponding to ¼ of the sheet thickness in the depth direction from the surface of the steel sheet).

The Vickers hardness is measured under a load of 10 gf in accordance with JIS Z 2244-1: 2020.

(Thickness)

The thickness of the soft layer is preferably 3 μm or more, more preferably 7 μm or more, and still more preferably 11 μm or more.

Meanwhile, the thickness of the soft layer is preferably 150 μm or less, more preferably 100 μm or less, and still more preferably 80 μm or less.

The thickness of the soft layer is determined as follows.

First, the Vickers hardness is measured at intervals of 1 μm from a position of 1 μm away from the surface of the steel sheet in the sheet thickness direction up to a position of 100 μm in the sheet thickness direction with a load of 10 gf using a Vickers hardness tester. Next, the Vickers hardness is measured at intervals of 20 μm up to the middle of the sheet thickness.

A cross section (L cross section) parallel to the rolling direction of the steel sheet is smoothed by wet polishing, and the Vickers hardness is then measured.

A portion (region) where the Vickers hardness measured in this manner is 85% or less with respect to the Vickers hardness at the ¼ position of the sheet thickness of the steel sheet is defined as the soft layer, and the thickness of this portion (region) in the sheet thickness direction is determined as the thickness (unit: μm) of the soft layer.

(Proportion r)

Nano-hardness at the ¼ position in depth in the sheet thickness direction of the soft layer is measured at 300 points or more (for example, 512 points) within a range of 50 μm×50 μm. At this time, the proportion of measurement points having nano-hardness of 7.0 GPa or more to the total number of measurement points is referred to as "proportion r".

The proportion r is, for example, 0.20 or less, preferably 0.15 or less, and more preferably 0.10 or less.

A smaller proportion r means that hard structures (such as martensite) and inclusions are less in the microstructure. When the microstructure has less hard structures and inclusions, generation of voids, connection of voids, and development of cracking can be further suppressed during press forming and collision. That is, bendability is further excellent, and fracture resistance during collision is further excellent (a value of $SF_{max}$ to be described later is good).

(Standard Deviation $\sigma_A$ and Standard Deviation $\sigma_B$)

The standard deviation of the nano-hardness at the ¼ position in depth in the sheet thickness direction of the soft layer is referred to as "standard deviation $\sigma_A$".

The standard deviation of the nano-hardness at the ½ position in depth in the sheet thickness direction of the soft layer is referred to as "standard deviation GB".

The standard deviation $\sigma_A$ is, for example, 2.0 GPa or less, preferably 1.8 GPa or less, and more preferably 1.7 GPa or less.

The standard deviation $\sigma_B$ is, for example, 2.5 GPa or less, preferably 2.2 GPa or less, and more preferably 2.1 GPa or less.

The standard deviation $\sigma_A$ and the standard deviation $\sigma_B$ being small mean that a difference in hardness among structures in the microstructure is small. In this case, generation of voids, connection of voids, and development of cracking can be further suppressed during press forming and collision. That is, bendability is further excellent, and fracture resistance during collision is further excellent.

The nano-hardness is hardness measured using a nano-indentation method.

More specifically, the nano-hardness at the ¼ and ½ positions in depth in the sheet thickness direction of the soft layer is determined as follows.

First, when a plated layer and/or a metal plated layer (both will be described later) are formed on the surface of the steel sheet, the plated layer and/or the metal plated layer are peeled off.

Thereafter, mechanical polishing is performed from the surface of the steel sheet up to the ¼ position (or the ½ position) in depth in the sheet thickness direction of the soft layer. Buffing is then performed using diamond and alumina, and polishing is further performed using colloidal silica. Thus, an L cross section at the ¼ position (or the ½ position) in depth in the sheet thickness direction of the soft layer is obtained.

Next, the nano-hardness of the L cross section of the soft layer is measured with a Berkovich shaped diamond indenter under the conditions of a load of 500 μN, a measurement region of 50 μm×50 μm, and a dotting interval of 2 μm using tribo-950 manufactured by Hysitron.

<Metal Plated Layer (Pre-Annealing Plated Layer)>

The high-strength steel sheet of the present invention may include a metal plated layer (also referred to as "pre-annealing plated layer") on the surface of the steel sheet. The metal plated layer is a layer different from a plated layer to be described later.

The metal plated layer is preferably a metal electroplated layer.

The metal plated layer contributes to suppression of occurrence of bending and cracking during press forming and collision, thus leading to more excellent bendability and also excellent fracture resistance during collision.

Examples of the metal element contained in the metal plated layer include at least one element selected from the group consisting of Cr, Mn, Fe, Co, Ni, Cu, Ga, Ge, As, Ru, Rh, Pd, Ag, Cd, In, Sn, Sb, Os, Ir, Rt, Au, Hg, Ti, Pb, and Bi. Among them, Fe or Ni is preferable.

That is, as the metal plated layer, a metal plated layer having a component composition constituted of Fe and inevitable impurities (hereinafter, also referred to as "Fe-based metal plated layer") is preferable.

Alternatively, the metal plated layer is preferably a metal plated layer having a component composition constituted of Ni and inevitable impurities (hereinafter, also referred to as "Ni-based metal plated layer").

The component composition of the Fe-based metal plated layer may further contain at least one element selected from the group consisting of B, C, P, N, O, Ni, Mn, Mo, Zn, W, Pb, Sn, Cr, V, and Co in an amount of 10 mass % or less in total. When C is contained, the C content is preferably 0.08 mass % or less.

The deposition amount (per one surface) of the metal plated layer is more than 0 g/m$^2$, preferably 2.0 g/m$^2$ or more, more preferably 5.0 g/m$^2$ or more, and still more preferably 8.0 g/m$^2$ or more.

Meanwhile, the upper limit of the deposition amount (per one surface) of the metal plated layer is not particularly limited, but is preferably 60.0 g/m$^2$ or less, more preferably 50.0 g/m$^2$ or less, still more preferably 40.0 g/m$^2$ or less, particularly preferably 30.0 g/m$^2$ or less, and most preferably 20.0 g/m$^2$ or less, from the viewpoint of cost.

The deposition amount of the metal plated layer is determined as follows.

First, the steel sheet on which the metal plated layer is formed is cut into a size of 10 mm×15 mm, and then embedded in a resin to obtain an embedded sample. The thickness of the metal plated layer is measured by observing arbitrary three places in a cross section of the embedded sample using a scanning electron microscope (SEM) at a magnification of 2000 to 10000 times according to the thickness of the metal plated layer under the condition of an acceleration voltage of 15 kV. By multiplying the average value of the thicknesses of the three places by the specific gravity of the metal element (for example, Fe) of the metal plated layer, the deposition amount per one surface of the metal plated layer is converted.

<Plated Layer>

The high-strength steel sheet of the present invention may include a plated layer on the surface of the steel sheet or the metal plated layer. The plated layer is a layer different from the above-described metal plated layer, and is formed by a plating treatment to be described later.

The plated layer is not particularly limited, and examples thereof include a hot-dip plated layer and an electroplated layer. The plated layer may be a plated layer that is alloyed (alloyed plated layer).

Examples of the plated layer include a zinc plated layer (Zn plated layer) and an Al plated layer, and among them, a zinc plated layer is preferable. The zinc plated layer may contain elements such as Al and Mg.

The composition of the plated layer is not particularly limited, and may be a general composition.

For example, when the plated layer is a galvanized layer or a galvannealed layer, the plated layer typically has a composition containing Fe in an amount of 20 mass % or less and Al in an amount of 0.001 to 1.0 mass %, and further containing at least one selected from the group consisting of Pb, Sb, Si, Sn, Mg, Mn, Ni, Cr, Co, Ca, Cu, Li, Ti, Be, Bi, and REM in an amount of 0 to 3.5 mass % in total, with the remaining part being Zn and inevitable impurities.

When the plated layer is a galvanized layer, the deposition amount per one surface of the plated layer is preferably 20 to 80 g/m$^2$. A galvannealed layer obtained by alloying such a deposition amount of the galvanized layer is also preferable.

When the plated layer is a galvanized layer, the content of Fe in the plated layer is preferably less than 7 mass %. When the plated layer is a galvannealed layer, the content of Fe in the plated layer is preferably 7 to 20 mass %, and more preferably 7 to 15 mass %.

When the plated layer is a zinc plated layer (galvanized layer or galvannealed layer), the deposition amount of the plated layer is determined as follows.

First, 0.6 g of a corrosion inhibitor (IBIT 700BK (registered trademark), manufactured by Asahi Chemical Co., Ltd.) for suppressing corrosion of Fe is added to 1 L of a 10 mass % aqueous hydrochloric acid solution to obtain a treatment liquid. The steel sheet on which the plated layer is formed is immersed as a test material in the obtained treatment liquid to dissolve the plated layer.

The mass reduction amount of the test material is determined by measuring the mass of the sample material before and after dissolution of the plated layer. The deposition amount (g/m$^2$) of the plated layer is obtained by dividing the obtained mass reduction amount by the area of the surface of the steel sheet (the area of the portion having been covered with the plated layer).

[Method for Manufacturing High-Strength Steel Sheet]

Next, a method for manufacturing a high-strength steel sheet according to the present invention (hereinafter, also referred to as "manufacturing method according to embodiments of the present invention" for convenience) will be described. The manufacturing method of the present invention is also a method for manufacturing the high-strength steel sheet according to embodiments of the present invention described above.

<Hot Rolling, Pickling, and Cold Rolling>

In the manufacturing method according to embodiments of the present invention, first, a steel slab having the component composition according to embodiments of the present invention described above is subjected to hot rolling, pickling, and cold rolling to obtain a cold-rolled steel sheet.

A method for smelting molten steel to be the steel slab (steel material) is not particularly limited, and a known smelting method using a converter or an electric furnace or the like can be adopted.

The steel slab is preferably manufactured by a continuous casting method in order to prevent macrosegregation, but can also be manufactured by other methods such as an ingot casting method and a thin slab casting method.

The manufactured steel slab is, for example, once cooled to room temperature, heated again to be subjected to hot rolling (rough rolling and finish rolling), and then wound up. Thus, a hot-rolled steel sheet is obtained.

It is to be noted that the manufactured steel slab may be charged into a heating furnace in the form of a hot piece without being cooled to room temperature, or may be rolled (rough-rolled) immediately after slight heat retention.

A rough-rolled steel sheet is obtained by rough-rolling the steel slab.

A temperature (slab heating temperature) at the time of rough-rolling the steel slab is preferably 1100° C. or higher from the viewpoint of dissolving carbides and reducing a rolling load. Meanwhile, in order to prevent an increase in scale loss, the slab heating temperature is preferably 1300° C. or lower.

The slab heating temperature is the surface temperature of the steel slab.

When the slab heating temperature is relatively low, it is preferable to heat the rough-rolled steel sheet using a bar heater or the like before finish rolling from the viewpoint of preventing troubles in hot rolling.

A temperature (finish rolling temperature) at the time of performing the finish rolling is preferably Ar3 transformation point or higher. This reduces a rolling load. Furthermore, the rolling reduction of austenite in an unrecrystallized state is decreased, and development of an abnormal structure elongated in the rolling direction is suppressed, so that workability is excellent.

The finish rolling may be continuously performed in a state where the rough-rolled steel sheets are joined. The rough-rolled steel sheet may be wound up once before the finish rolling is performed.

In order to reduce the rolling load, some or all of the finish rolling may be lubricating rolling. The lubricating rolling is also preferable from the viewpoint of uniformizing the shape and material of the steel sheet. A friction coefficient at the time of the lubricating rolling is preferably within a range of 0.10 to 0.25.

A winding temperature after hot rolling is preferably 300 to 700° C. from the viewpoint of improving the stability of manufacturing line in cold rolling and annealing to be described later.

Next, the hot-rolled steel sheet obtained by hot rolling is pickled. Oxides on the surface of the hot-rolled steel sheet are removed by pickling, so that the high-strength steel sheet, which is a final product, is excellent in chemical convertibility and quality of the plated layer, and the like. The pickling may be performed once or may be divided into plural times.

The hot-rolled steel sheet after pickling is optionally subjected to a softening heat treatment, and then subjected to cold rolling. Thus, a cold-rolled steel sheet is obtained. The conditions for cold rolling are not particularly limited, but the cumulative rolling reduction of cold rolling is preferably 20 to 75%. The number of times of rolling passes and the rolling reduction of each pass are not particularly limited.

The cold-rolled steel sheet thus obtained is optionally subjected to a metal plating treatment (pre-annealing plating treatment) to be described later, and then subjected to annealing and post-heating to be described later.

Before performing the metal plating treatment (pre-annealing plating treatment), the hot-rolled steel sheet (including the hot-rolled steel sheet after pickling) and the cold-rolled steel sheet described above may be subjected to some annealing.

<Metal Plating Treatment (Pre-Annealing Plating Treatment)>

The metal plating treatment (pre-annealing plating treatment) is a treatment for forming the above-described metal plated layer (pre-annealing plated layer) on the surface (at least one surface) of the cold-rolled steel sheet before being subjected to annealing to be described later.

As the metal plating treatment, a metal electroplating treatment is preferable. With this, the metal electroplated layer can be formed as the metal plated layer.

As an electroplating bath used for the metal electroplating treatment, a sulfuric acid bath, a hydrochloric acid bath, or a mixed bath of both, or the like can be used. The deposition amount of the metal electroplated layer to be formed can be adjusted by, for instance, the energization time of the metal electroplating treatment.

Examples of the metal element contained in the electroplating bath include at least one element selected from the group consisting of Cr, Mn, Fe, Co, Ni, Cu, Ga, Ge, As, Ru, Rh, Pd, Ag, Cd, In, Sn, Sb, Os, Ir, Rt, Au, Hg, Ti, Pb, and Bi. Among them, Fe or Ni is preferable.

The electroplating bath may further contain at least one element selected from the group consisting of B, C, P, N, O, Ni, Mn, Mo, Zn, W, Pb, Sn, Cr, V, and Co.

The total content of these elements in the electroplating bath is preferably such an amount that the total content of these elements in the metal plated layer to be formed is 10 mass % or less.

The content of Fe ions ($Fe^{2+}$) or Ni ions ($Ni^{2+}$) in the electroplating bath before the start of energization is preferably 0.5 to 2.0 mol/L.

The electroplating bath may contain metal elements as metal ions and nonmetal elements as a part of boric acid, phosphoric acid, nitric acid, and organic acid and the like.

The electroplating bath may further contain a conductivity aid such as sodium sulfate or potassium sulfate; a chelating agent; and a pH buffering agent and the like.

The temperature of the electroplating bath is preferably 30 to 85° C. from the viewpoint of constant temperature retainability.

The pH of the electroplating bath is preferably 1.0 or more from the viewpoint of preventing a decrease in current efficiency due to generation of hydrogen, and is preferably 3.0 or less in consideration of electrical conductivity.

The current density is preferably 10 A/dm$^2$ or more from the viewpoint of productivity, and is preferably 150 A/dm$^2$ or less from the viewpoint of facilitating control of the deposition amount of the metal electroplated layer to be formed.

A speed (sheet passing speed) at which the cold-rolled steel sheet is passed through the electroplating bath is preferably 5 mpm or more from the viewpoint of productivity, and preferably 150 mpm or less from the viewpoint of stably controlling the deposition amount of the metal electroplated layer to be formed.

As the pretreatment of the metal electroplating treatment, degreasing and water washing for cleaning the surface of the cold-rolled steel sheet, and pickling and water washing for activating the surface of the cold-rolled steel sheet may be performed.

The method of degreasing and water washing is not particularly limited, and a normal method can be used.

For pickling, various acid liquids such as sulfuric acid, hydrochloric acid, nitric acid, and a mixture thereof can be used. Among them, sulfuric acid, hydrochloric acid, or a mixture thereof is preferable. The concentration of the acid liquid is preferably 1 to 20 mass % in consideration of capability of removal of an oxide film, and prevention of surface defects due to excessive pickling, and the like. An antifoaming agent, a pickling accelerator, or a pickling inhibitor or the like may be added to the acid liquid.

<Annealing>

Next, the obtained cold-rolled steel sheet is subjected to annealing.

Briefly speaking, in the annealing, the cold-rolled steel sheet is heated at a heating temperature to be described later, and then cooled to a cooling stop temperature to be described later.

<<Heating Temperature: 800° C. or Higher>>

If the heating temperature is too low, heating is performed in a two-phase region of ferrite and austenite, so that the area ratio of martensite is lowered and desired TS is not obtained. Therefore, the heating temperature is 800° C. or higher, and preferably 820° C. or higher.

The upper limit of the heating temperature is not particularly limited, but is preferably 950° C. from the viewpoint of operability and the like.

A time (heating time) for heating the cold-rolled steel sheet at the heating temperature is not particularly limited, but is preferably 30 s or more, and more preferably 60 s or more because there is a possibility that reverse transformation to austenite does not sufficiently proceed when the time is too short.

The upper limit of the heating time is not particularly limited, and is, for example, 6000 s, and preferably 3000 s.

Note that "s" means seconds.

<<Dew Point: −30° C. or Higher>>

The dew point of an atmosphere when the cold-rolled steel sheet is heated at the heating temperature described above is preferably −30° C. or higher, more preferably −20° C. or higher, still more preferably −15° C. or higher, and particularly preferably −5° C. or higher. With this, the decarburization reaction of the cold-rolled steel sheet is promoted, and the soft layer described above is easily formed.

Meanwhile, the dew point is preferably 30° C. or lower from the viewpoint of suitably preventing the surface oxidation of the metal plated layer (pre-annealing plated layer) and improving the adhesion of the plated layer to be formed by a plating treatment to be described later.

<<Staying Time t1 in Temperature Range T1 of Higher than Ms ° C. and 700° C. or Lower: 1000 s or Less>>

The cold-rolled steel sheet cooled to the cooling stop temperature after heating passes through a temperature range T1 of Ms ° C. or higher and 700° C. or lower. When a time during which the cold-rolled steel sheet stays in the temperature range T1 (staying time t1) is too long, ferrite transformation excessively occurs, and the area ratio of ferrite increases, so that good stretch flangeability and bendability are not obtained.

Therefore, the staying time t1 is 1000 s or less, preferably 500 s or less, and more preferably 300 s or less.

The lower limit of the staying time t1 is not particularly limited, but is preferably 1 s, more preferably 5 s, and still more preferably 10 s, from the viewpoint of reducing the burden of facility investment.

The cooling in the temperature range T1 may be either continuous cooling or intermittent cooling. However, intermittent cooling is preferable from the viewpoint of alleviating a stress generated with structural change during cooling, achieving a good steel sheet shape, and obtaining better stretch flangeability and bendability.

<<First Average Cooling Rate v1 in Temperature Range T2 of Ms-80° C. or Higher and Ms ° C. or Lower: 1.0° C./s or More and 40.0° C./s or Less>>

The cold-rolled steel sheet having passed through the temperature range T1 (Ms ° C. or higher and 700° C. or lower) then passes through a temperature range T2 of Ms-80° C. or higher and lower than Ms ° C. By cooling the cold-rolled steel sheet at a first average cooling rate v1 to be described later in the temperature range T2, C is distributed from martensite generated at Ms ° C. or lower into untransformed austenite.

When the first average cooling rate v1 is too low, C distributed into untransformed austenite is coarsely precipitated as cementite, resulting in deteriorated bendability.

Therefore, the first average cooling rate v1 is 1.0° C./s or more, preferably 2.0° C./s or more, and more preferably 3.0° C./s or more.

Meanwhile, when the first average cooling rate v1 is too high, C is less likely to be distributed into untransformed austenite, and the precipitation driving force of the metastable carbides decreases in post-heating to be described later, so that sufficient delayed fracture resistance is not obtained.

Therefore, the first average cooling rate v1 is 40.0° C./s or less, preferably 25.0° C./s or less, and more preferably 20.0° C./s or less.

The cooling in the temperature range T2 is preferably continuous cooling.

<<Second Average Cooling Rate v2 in Temperature Range T3 of 150° C. or Higher and Lower than Ms-80° C.: 0.3° C./s or More and Less than First Average Cooling Rate v1>>

The cold-rolled steel sheet having passed through the temperature range T2 then passes through a temperature range T3 of 150° C. or higher and lower than Ms-80° C. The cold-rolled steel sheet is cooled at a second average cooling rate v2 to be described later in the temperature range T3.

This increases the proportion (proportion p) of the number of martensite blocks in which metastable carbides are present to the number of martensite blocks in the finally obtained microstructure.

The reason is presumed as follows.

In the temperature range T3, martensite transformation proceeds in untransformed austenite in which C is concentrated. At this time, C partially diffuses in the martensite block, and the precursor stage of metastable carbides is generated. As a result, precipitation of the metastable carbides is significantly promoted in the subsequent post-heating.

When the second average cooling rate v2 is too low, C diffuses from the inside of the martensite block to the interface on the untransformed austenite side. As a result, retained austenite increases and good part strength and stretch flangeability are not obtained.

Therefore, the second average cooling rate v2 is 0.3° C./s or more, preferably 0.5° C./s or more, and more preferably 1.0° C./s or more.

Meanwhile, the second average cooling rate v2 is less than the first average cooling rate v1.

When the second average cooling rate v2 is higher than or equal to the first average cooling rate v1, the diffusion of C in martensite is insufficient, and the precursor stage of the metastable carbides is not sufficiently generated. As a result, in the subsequent post-heating, precipitation of the metastable carbides is suppressed, and the proportion p decreases, so that the delayed fracture resistance becomes insufficient.

The cooling in the temperature range T3 is preferably continuous cooling.

Ms refers to a temperature (Ms point) at which martensitic transformation starts to occur, and a value measured by a Formaster test is used.

<<Bending-Unbending Processing>>

During the annealing, the cold-rolled steel sheet may be subjected to bending-unbending processing one or more times.

The bending-unbending processing is preferably performed in a temperature range of 150° C. or higher and Ms ° C. or lower.

The bending-unbending processing is bending processing performed in a direction perpendicular to the rolling direction and subsequent unbending processing. The martensitic transformation is promoted by the bending-unbending processing. Accordingly, in post-heating to be described later, the metastable carbides are efficiently precipitated, and the proportion (proportion p) of the number of martensite blocks in which metastable carbides are present to the number of martensite blocks increases.

From the viewpoint of further increasing the proportion p, the number of times of the bending-unbending processing is preferably 1 or more, more preferably 2 or more, and still more preferably 3 or more.

Meanwhile, when the number of times of the bending-unbending processing is too large, El may be lowered due to significant work hardening. Therefore, the number of times of the bending-unbending processing is preferably 10 or less, more preferably 8 or less, and still more preferably 5 or less.

The method of the bending-unbending processing is not particularly limited, but typical examples thereof include a method using a roll. The diameter of the roll used for the bending-unbending processing is not particularly limited, but is preferably 300 to 2000 mm.

<<Cooling Stop Temperature: 150° C. or Lower>>

A cooling stop temperature is 150° C. or lower. With this, the martensitic transformation is sufficiently completed. When the cooling stop temperature is higher than 150° C., untransformed austenite does not undergo martensitic transformation, and the amount of retained austenite becomes excessively large, so that good part strength and stretch flangeability are not obtained.

The cold-rolled steel sheet cooled to the cooling stop temperature may be further cooled to room temperature.

A cooling rate from the cooling stop temperature to room temperature is not particularly limited. A cooling method is not particularly limited, and any method can be adopted. For example, methods such as gas jet cooling, mist cooling, water cooling, and air cooling can be adopted.

<Post-Heating>

The cold-rolled steel sheet having been subjected to annealing (heating and cooling) is then subjected to post-heating.

By performing the post-heating, metastable carbides that improve the delayed fracture resistance are precipitated in the martensite block generated during cooling in the annealing described above. As a result, a high-strength steel sheet having TS of 1180 MPa or more that is excellent in delayed fracture resistance while having good part strength, stretch flangeability, and bendability is obtained.

<<Formula 1>>

More specifically, the cold-rolled steel sheet having been subjected to annealing is subjected to post-heating under the condition that a temperature X (unit: ° C.) that is a maximum end-point temperature and a retention time Y (unit: s) at the temperature X-10° C. or higher satisfy the following Formula 1. With this, the proportion (proportion p) of the number of martensite blocks in which metastable carbides are present to the number of martensite blocks increases, and the delayed fracture resistance is excellent.

$$8000 \leq (273 + X) \times (20 + \mathrm{Log}(Y/3600)) \leq 12000 \qquad \text{Formula 1}$$

"(273+X)×(20+Log(Y/3600))" in the above Formula 1 is hereinafter referred to as "variable part Z" for convenience.

When the value of the variable part Z is too small, that is, when the temperature X is too low and/or the retention time Y is too short, the metastable carbides are not sufficiently precipitated, so that the proportion p decreases.

Therefore, the value of the variable part Z is 8000 or more, preferably 8500 or more, and more preferably 9000 or more because the proportion p increases.

Meanwhile, when the value of the variable part Z is too high, that is, when the temperature X is too high and/or the retention time Y is too long, transition of the metastable carbides to cementite occurs, and the proportion p decreases.

Therefore, the value of the variable part Z is 12000 or less, preferably 11500 or less, and more preferably 11000 or less because the proportion p increases.

<<Formula 2>>

In the post-heating, the temperature X (unit: ° C.) preferably satisfies the following Formula 2. This increases the number density (number density n) of the metastable carbides in the martensite block where the metastable carbides are present.

$$100 \leq X \leq 400 \qquad \text{Formula 2}$$

That is, the temperature X is preferably 100° C. or higher, more preferably 120° C. or higher, and still more preferably 150° C. or higher because the number density n increases.

For the same reason, the temperature X is preferably 400° C. or lower, more preferably 380° C. or lower, and still more preferably 350° C. or lower.

The cold-rolled steel sheet having been subjected to post-heating is then cooled to, for example, room temperature.

Thus, the high-strength steel sheet according to embodiments of the present invention is obtained by the manufacturing method according to embodiments of the present invention.

In the manufacturing method according to embodiments of the present invention, when a plating treatment to be described later is performed, the high-strength steel sheet according to embodiments of the present invention to be obtained is a plated steel sheet having a plated layer.

In a series of heat treatments in the manufacturing method according to embodiments of the present invention, other conditions are not particularly limited as long as the above-described thermal history is satisfied, and equipment or the like for performing the heat treatments is not also particularly limited.

<Plating Treatment>

In the manufacturing method according to embodiments of the present invention, the cold-rolled steel sheet may be subjected to a plating treatment.

Examples of the plating treatment include a galvanizing treatment (treatment for forming a galvanized layer) and a galvannealing treatment (treatment for forming a galvannealed layer by performing an alloying treatment after the galvanizing treatment). The electroplated layer may be formed by the electroplating treatment.

For example, the cold-rolled steel sheet staying in the temperature range T1 (Ms ° C. or higher and 700° C. or lower) is subjected to the plating treatment.

When the galvanizing treatment is performed, it is preferable to immerse the cold-rolled steel sheet in a zinc plating bath at 440 to 500° C., and then adjust the deposition amount of the plated layer by gas wiping or the like.

The amount of Al in the zinc plating bath is preferably 0.10 to 0.23 mass %.

The galvanizing treatment is preferably performed during staying in the temperature range T1 (Ms ° C. or higher and 700° C. or lower) during the annealing described above.

If the temperature of the alloying treatment is too low, a Zn—Fe alloying rate may be excessively slow, resulting in impaired productivity, so that the temperature of the alloying treatment is preferably 470° C. or higher.

Meanwhile, if the temperature of the alloying treatment is too high, untransformed austenite may transform into pearlite, resulting in lowered TS, so that the temperature of the alloying treatment is preferably 600° C. or lower, and more preferably 560° C. or lower.

Skin pass rolling may be performed after the plating treatment.

A rolling reduction in the skin pass rolling is preferably 0.05% or more from the viewpoint of increasing the yield strength. The upper limit of the rolling reduction is not particularly limited, but is preferably 1.50% from the viewpoint of productivity.

The skin pass rolling may be performed online or offline.

The skin pass with a desired rolling reduction may be performed at a time, or may be divided into several times.

From the viewpoint of productivity, a series of treatments such as the annealing and plating treatments described above are preferably performed on a CAL (Continuous Annealing Line) or a CGL (Continuous Galvanizing Line).

EXAMPLES

Hereinafter, the present invention will be specifically described with reference to Examples. However, the present invention is not limited to Examples described below.

Test Example 1

<Manufacture of Steel Sheet>

Molten steels having component compositions shown in the following Tables 1 and 2 (the remaining part consists of Fe and inevitable impurities) were smelted in a converter, and made into steel slabs by a continuous casting method.

Each of the obtained steel slabs was subjected to hot rolling to obtain a hot-rolled steel sheet. Specifically, the steel slab was heated to 1250° C., subjected to rough rolling, subjected to finish rolling at a finish rolling temperature of 900° C., wound up under the condition of 500° C., and then cooled to room temperature to obtain a hot-rolled steel sheet.

The obtained hot-rolled steel sheet was subjected to pickling, subsequently subjected to a softening heat treatment under the condition of 500° C., and then subjected to cold rolling under the condition of a rolling ratio of 50%. Thus, a cold-rolled steel sheet having a sheet thickness of 1.4 mm was obtained.

The obtained cold-rolled steel sheet was subjected to annealing and post-heating under the conditions shown in the following Table 3 to obtain a steel sheet.

A heating time at the heating temperature was 200 s.

Bending-unbending processing was performed in the temperature range T2 and the temperature range T3.

<<Plating Treatment>>

Some of the cold-rolled steel sheets were subjected to a galvanizing treatment during staying in the temperature range T1 (Ms ° C. or higher and 700° C. or lower) to form plated layers (galvanized layers) on both surfaces. That is, a galvanized steel sheet (GI) was obtained.

In the galvanizing treatment, a galvanizing bath (bath temperature: 470° C.) containing Al in an amount of 0.20 mass % with the remaining part being Zn and inevitable impurities was used.

The deposition amount of the galvanized layer per one surface was about 45 g/m$^2$.

The composition of the galvanized layer thus formed was a composition containing Fe in an amount of 0.1 to 1.0 mass % and Al in an amount of 0.2 to 1.0 mass %, with the remaining part consisting of Fe and inevitable impurities.

Some of the other cold-rolled steel sheets were subjected to a galvannealing treatment during staying in the temperature range T1 (Ms ° C. or higher and 700° C. or lower) to form plated layers (galvannealed layers) on both surfaces. That is, a galvannealed steel sheet (GA) was obtained.

In the galvanizing treatment, a galvanizing bath (bath temperature: 470° C.) containing Al in an amount of 0.14 mass % with the remaining part being Zn and inevitable impurities was used.

The alloying treatment was performed at 550° C.

The deposition amount of the galvannealed layer per one surface was about 45 g/m$^2$.

The composition of the galvannealed layer thus formed was a composition containing Fe in an amount of 7 to 15 mass % and Al in an amount of 0.1 to 1.0 mass %, with the remaining part consisting of Fe and inevitable impurities.

"GI" in the case of forming a galvanized layer, "GA" in the case of forming a galvannealed layer, and "CR" in the case of not forming a plated layer were put in the column of "type" in the following Table 3.

Hereinafter, a galvanized steel sheet (GI) and a galvannealed steel sheet (GA) are also simply referred to as "steel sheet".

<Observation of Microstructure>

For each of the obtained steel sheets, the area ratios of martensite, ferrite, and retained austenite, the proportion (proportion p) of the number of martensite blocks in which metastable carbides were present to the number of martensite blocks, and the number density (number density n) of the metastable carbides in the martensite blocks in which the metastable carbides were present were measured according to the methods described above. The results are shown in the following Table 4.

For the obtained steel sheets, the remaining structures other than martensite, ferrite, and retained austenite were all 0 (cementite precipitated in ferrite).

<Evaluation>

The obtained steel sheets were subjected to tests described below to evaluate various characteristics. The results are shown in the following Table 4.

<<Tensile Test>>

A tensile test was performed in accordance with JIS Z 2241.

Specifically, a JIS No. 5 test piece was collected from each of the obtained steel sheets so that a direction perpendicular to the rolling direction of the steel sheet was a longitudinal direction. The collected test piece was subjected to the tensile test under the condition of a cross head speed of $1.67\times10^{-1}$ mm/s to measure yield strength (YS) [MPa], tensile strength (TS) [MPa], and total elongation (El) [%]. Furthermore, a yield ratio (YR) (=100×YS/TS) [%] was calculated.

When the tensile strength (TS) was 1180 MPa or more, the strength was determined to be high.

When the yield ratio (YR) was 65% or more, part strength was determined to be excellent.

<<Hole Expansion Test>>

A hole expansion test was performed in accordance with JIS Z 2256.

Specifically, each of the obtained steel sheets was sheared to collect a test piece having a size of 100 mm×100 mm. A hole having a diameter of 10 mm was punched into the collected test piece with a clearance of 12.5%. Thereafter, using a die with an inner diameter of 75 mm, a conical punch having an apex angle of 60° was forced into the hole with a blank holding force of 9 ton (88.26 kN) being applied, and a hole diameter $D_f$ [mm] at the crack generation limit was measured. Assuming that an initial hole diameter was $D_0$ [mm], a hole expansion ratio λ [%] was obtained from the following Formula.

$$\lambda = \{(D_f - D_0)/D_0\} \times 100$$

When the hole expansion ratio (λ) was 30% or more, stretch flangeability was determined to be excellent.

<<Bending Test>>

A bending test was performed in accordance with JIS Z 2248.

Specifically, a strip-shaped test piece having a width of 30 mm and a length of 100 mm was collected from each of the obtained steel sheets so that a direction parallel to the rolling direction of the steel sheet was the axial direction of the bending test. The collected test piece was subjected to a 90° V-bending test under the conditions of an indentation load of 100 kN and a pressing retention time of 5 seconds.

Five test pieces were subjected to the bending test with a maximum bending radius R at which a value (R/t) obtained by dividing a bending radius R by a sheet thickness t was 5 or less (for example, when the sheet thickness t was 1.4 mm, the bending radius R was 7.0 mm). Next, the presence or absence of occurrence of cracking in the ridge portion of a bending vertex was checked.

The presence or absence of occurrence of cracking was checked by observing the ridge portion of the bending vertex using a digital microscope (RH-2000, manufactured by Hirox Co., Ltd.) at a magnification of 40 times.

Only when no cracking occurred in all of the five test pieces, bendability was determined to be excellent, and "excellent" was put in the following Table 4.

Meanwhile, when cracking occurred in any of the five test pieces, bendability was determined to be insufficient, and "poor" was put in the following Table 4.

<<Delayed Fracture Test>>

From each of the obtained steel sheets, a strip-shaped test piece having a width of 70 mm and a length of 16 mm was collected so that a direction perpendicular to the rolling direction of the steel sheet was a mechanical grinding end surface. Bending deformation was applied to the collected test piece so that a stress equivalent to 800 MPa was applied to the central portion of the test piece by four-point bending.

Subsequently, the test piece having been subjected to bending deformation was immersed in a 0.1 mass % ammonium thiocyanate solution at 25° C., the pH of which was adjusted to 5.0 using a McIlvaine buffer solution.

Thereafter, the test piece in this solution was observed to check the presence or absence of occurrence of cracking.

For a test piece collected from a steel sheet having TS of 1180 MPa or more and less than 1700 MPa, "E" when cracking was confirmed after a lapse of 48 hours, "D" when cracking was not confirmed after a lapse of 48 hours but cracking was confirmed before a lapse of 60 hours, "C" when cracking was not confirmed after a lapse of 60 hours but cracking was confirmed before a lapse of 72 hours, "B" when cracking was not confirmed after a lapse of 72 hours but cracking was confirmed before a lapse of 96 hours, and "A" when cracking was not confirmed after a lapse of 96 hours were put in the following Table 4.

For a test piece collected from a steel sheet having TS of 1700 MPa or more, "E" when cracking was confirmed after a lapse of 24 hours, "D" when cracking was not confirmed after a lapse of 24 hours but cracking was confirmed before a lapse of 36 hours, "C" when cracking was not confirmed after a lapse of 36 hours but cracking was confirmed before a lapse of 48 hours, "B" when cracking was not confirmed after a lapse of 48 hours but cracking was confirmed before a lapse of 60 hours, and "A" when cracking was not confirmed after a lapse of 60 hours were put in the following Table 4.

From the reason of having excellent delayed fracture resistance, "D", "C", "B" or "A" is preferable, "C", "B" or "A" is more preferable, "B" or "A" is still more preferable, and "A" is particularly preferable.

Underlines in the following Tables 1 to 4 mean outside the scope of the present invention.

TABLE 1

| Steel | Component composition [mass %] | | | | | | | | | | | | | | |
|---|---|---|---|---|---|---|---|---|---|---|---|---|---|---|---|
| type | C | Si | Mn | P | S | Al | N | O | Ti | Nb | V | B | Mo | Cr | Cu |
| A | 0.191 | 0.98 | 3.07 | 0.005 | 0.0010 | 0.034 | 0.0043 | 0.0006 | — | — | — | — | — | — | — |
| B | 0.190 | 0.61 | 3.14 | 0.013 | 0.0006 | 0.029 | 0.0042 | 0.0006 | — | — | — | — | — | — | — |
| C | 0.215 | 0.15 | 3.10 | 0.018 | 0.0004 | 0.028 | 0.0030 | 0.0005 | — | — | — | — | — | — | — |
| D | 0.287 | 1.02 | 3.01 | 0.005 | 0.0014 | 0.044 | 0.0030 | 0.0010 | — | — | — | — | — | — | — |
| E | 0.105 | 1.01 | 3.12 | 0.014 | 0.0008 | 0.046 | 0.0025 | 0.0006 | — | — | — | — | — | — | — |
| F | 0.084 | 0.57 | 3.11 | 0.017 | 0.0008 | 0.037 | 0.0040 | 0.0006 | — | — | — | — | — | — | — |
| G | 0.128 | 2.09 | 3.02 | 0.018 | 0.0008 | 0.039 | 0.0030 | 0.0007 | — | — | — | — | — | — | — |
| H | 0.178 | 0.87 | 1.88 | 0.020 | 0.0011 | 0.046 | 0.0039 | 0.0007 | — | — | — | — | — | — | — |
| I | 0.200 | 1.11 | 4.35 | 0.012 | 0.0005 | 0.027 | 0.0025 | 0.0012 | — | — | — | — | — | — | — |
| J | 0.274 | 0.87 | 3.21 | 0.017 | 0.0003 | 0.026 | 0.0040 | 0.0006 | 0.035 | — | — | — | — | — | — |
| K | 0.178 | 0.75 | 3.09 | 0.012 | 0.0007 | 0.030 | 0.0038 | 0.0005 | — | 0.022 | — | — | — | — | — |
| L | 0.152 | 0.60 | 3.01 | 0.015 | 0.0009 | 0.039 | 0.0044 | 0.0011 | — | — | 0.045 | — | — | — | — |
| M | 0.185 | 0.72 | 3.08 | 0.014 | 0.0012 | 0.040 | 0.0031 | 0.0006 | 0.019 | — | — | 0.0025 | — | — | — |
| N | 0.267 | 1.05 | 3.45 | 0.017 | 0.0005 | 0.027 | 0.0044 | 0.0006 | — | — | — | — | 0.06 | — | — |
| O | 0.175 | 0.50 | 2.60 | 0.012 | 0.0011 | 0.034 | 0.0036 | 0.0007 | — | — | — | — | — | 0.60 | — |
| P | 0.201 | 1.15 | 3.68 | 0.016 | 0.0010 | 0.028 | 0.0036 | 0.0006 | — | — | — | — | — | — | 0.08 |
| Q | 0.353 | 1.07 | 3.14 | 0.013 | 0.0014 | 0.046 | 0.0038 | 0.0006 | — | — | — | — | — | — | — |
| R | 0.160 | 0.98 | 3.02 | 0.017 | 0.0009 | 0.047 | 0.0037 | 0.0005 | — | — | — | — | — | — | — |
| S | 0.272 | 0.73 | 3.06 | 0.012 | 0.0005 | 0.034 | 0.0038 | 0.0012 | — | — | — | — | — | — | — |
| T | 0.175 | 1.02 | 3.14 | 0.009 | 0.0013 | 0.042 | 0.0036 | 0.0007 | — | — | — | — | — | — | — |
| U | 0.189 | 0.54 | 2.09 | 0.009 | 0.0009 | 0.040 | 0.0033 | 0.0006 | 0.018 | — | — | 0.0018 | — | — | 0.11 |
| V | 0.187 | 1.35 | 3.21 | 0.013 | 0.0008 | 0.046 | 0.0043 | 0.0006 | — | — | — | — | — | — | — |
| W | 0.282 | 0.72 | 2.78 | 0.019 | 0.0006 | 0.030 | 0.0040 | 0.0007 | — | — | — | — | — | — | — |
| X | 0.197 | 0.58 | 2.67 | 0.010 | 0.0008 | 0.033 | 0.0035 | 0.0007 | — | — | — | — | — | — | — |
| Y | 0.268 | 0.58 | 2.78 | 0.010 | 0.0006 | 0.032 | 0.0033 | 0.0013 | — | — | — | — | — | — | — |
| Z | 0.184 | 0.98 | 3.11 | 0.011 | 0.0012 | 0.027 | 0.0037 | 0.0006 | 0.022 | 0.015 | — | 0.0021 | — | — | — |
| AA | 0.187 | 0.53 | 2.89 | 0.009 | 0.0008 | 0.016 | 0.0027 | 0.0005 | — | — | — | — | — | — | — |
| AB | 0.180 | 0.62 | 2.96 | 0.007 | 0.0011 | 0.020 | 0.0031 | 0.0006 | — | — | — | — | — | — | — |
| AC | 0.182 | 0.76 | 2.99 | 0.006 | 0.0007 | 0.023 | 0.0028 | 0.0006 | — | — | — | — | — | — | — |
| AD | 0.201 | 0.61 | 3.07 | 0.005 | 0.0008 | 0.034 | 0.0036 | 0.0007 | — | — | — | — | — | — | — |

TABLE 2

| Steel | Component composition [mass %] | | | | | | | | | | | | | Ms | |
|---|---|---|---|---|---|---|---|---|---|---|---|---|---|---|---|
| type | Ni | Sb | Sn | Ta | Ca | Mg | Co | Zr | REM | Te | Hf | Bi | W | [° C.] | Remarks |
| A | — | — | — | — | — | — | — | — | — | — | — | — | — | 330 | Inventive steel |
| B | — | — | — | — | — | — | — | — | — | — | — | — | — | 332 | Inventive steel |
| C | — | — | — | — | — | — | — | — | — | — | — | — | — | 330 | Inventive steel |
| D | — | — | — | — | — | — | — | — | — | — | — | — | — | 302 | Inventive steel |
| E | — | — | — | — | — | — | — | — | — | — | — | — | — | 355 | Inventive steel |
| F | — | — | — | — | — | — | — | — | — | — | — | — | — | 366 | Comparative steel |
| G | — | — | — | — | — | — | — | — | — | — | — | — | — | 339 | Comparative steel |
| H | — | — | — | — | — | — | — | — | — | — | — | — | — | 374 | Comparative steel |
| I | — | — | — | — | — | — | — | — | — | — | — | — | — | 284 | Comparative steel |

TABLE 2-continued

| Steel type | Component composition [mass %] Ni | Sb | Sn | Ta | Ca | Mg | Co | Zr | REM | Te | Hf | Bi | W | Ms [° C.] | Remarks |
|---|---|---|---|---|---|---|---|---|---|---|---|---|---|---|---|
| J | — | — | — | — | — | — | — | — | — | — | — | — | — | 301 | Inventive steel |
| K | — | — | — | — | — | — | — | — | — | — | — | — | — | 336 | Inventive steel |
| L | — | — | — | — | — | — | — | — | — | — | — | — | — | 348 | Inventive steel |
| M | — | — | — | — | — | — | — | — | — | — | — | — | — | 334 | Inventive steel |
| N | — | — | — | — | — | — | — | — | — | — | — | — | — | 294 | Inventive steel |
| O | — | — | — | — | — | — | — | — | — | — | — | — | — | 355 | Inventive steel |
| P | — | — | — | — | — | — | — | — | — | — | — | — | — | 305 | Inventive steel |
| Q | 0.11 | — | — | — | — | — | — | — | — | — | — | — | — | 277 | Inventive steel |
| R | — | 0.009 | — | — | — | — | — | — | — | — | — | — | — | 341 | Inventive steel |
| S | — | — | 0.012 | — | — | — | — | — | — | — | — | — | — | 308 | Inventive steel |
| T | — | — | — | 0.01 | — | — | — | — | — | — | — | — | — | 332 | Inventive steel |
| U | — | — | — | — | — | — | — | — | — | — | — | — | — | 367 | Inventive steel |
| V | — | — | — | — | 0.0015 | — | — | — | — | — | — | — | — | 323 | Inventive steel |
| W | — | — | — | — | — | 0.0011 | — | — | — | — | — | — | — | 314 | Inventive steel |
| X | — | — | — | — | — | — | 0.005 | 0.020 | — | — | — | — | — | 351 | Inventive steel |
| Y | — | — | — | — | — | — | — | — | 0.0019 | — | — | — | — | 320 | Inventive steel |
| Z | — | 0.011 | — | — | — | — | — | — | — | — | — | — | — | 331 | Inventive steel |
| AA | — | — | — | — | — | — | — | — | — | 0.030 | — | — | — | 342 | Inventive steel |
| AB | — | — | — | — | — | — | — | — | — | — | 0.03 | — | — | 341 | Inventive steel |
| AC | — | — | — | — | — | — | — | — | — | — | — | 0.005 | — | 338 | Inventive steel |
| AD | — | — | — | — | — | — | — | — | — | — | — | — | 0.02 | 330 | Inventive steel |

TABLE 3

| No. | Steel type | Heating temperature [° C.] | Staying time t1 (temperature range T1) [s] | First average cooling rate v1 (temperature range T2) [° C./s] | Second average cooling rate v2 (temperature range T3) [° C./s] | Number of times of bending-unbending processing [times] | Cooling stop temperature [° C.] | Temperature X [° C.] | Retention time Y [s] | Variable part Z of Formula 1 | Type | Remarks |
|---|---|---|---|---|---|---|---|---|---|---|---|---|
| 1 | A | 900 | 150 | 5.0 | 1.5 | 3 | 25 | 220 | 36000 | 10353 | GA | Inventive Example |
| 2 | A | 730 | 150 | 5.0 | 3.0 | 3 | 25 | 200 | 7200 | 9602 | GA | Comparative Example |
| 3 | A | 900 | 1200 | 5.0 | 3.0 | 3 | 25 | 200 | 7200 | 9602 | GA | Comparative Example |
| 4 | A | 875 | 150 | 50.0 | 2.0 | 3 | 25 | 200 | 7200 | 9602 | GA | Comparative Example |
| 5 | A | 900 | 150 | 5.0 | 15.0 | 3 | 50 | 220 | 7200 | 10008 | GA | Comparative Example |
| 6 | A | 900 | 150 | 5.0 | 0.2 | 3 | 50 | 250 | 7200 | 10617 | GA | Comparative Example |
| 7 | A | 900 | 150 | 5.0 | 1.5 | 0 | 25 | 220 | 36000 | 10353 | GA | Inventive Example |
| 8 | A | 875 | 150 | 8.0 | 2.0 | 3 | 180 | 200 | 7200 | 9602 | GA | Comparative Example |
| 9 | A | 900 | 150 | 8.0 | 3.0 | 3 | 25 | 160 | 30 | 7760 | GA | Comparative Example |
| 10 | A | 900 | 150 | 8.0 | 3.0 | 3 | 25 | 320 | 36000 | 12453 | GA | Comparative Example |
| 11 | A | 900 | 150 | 5.0 | 1.5 | 3 | 25 | 405 | 10 | 11827 | GA | Inventive Example |
| 12 | A | 900 | 150 | 35.0 | 20.0 | 3 | 120 | 300 | 60 | 10441 | GA | Inventive Example |
| 13 | B | 900 | 150 | 4.0 | 1.5 | 2 | 15 | 220 | 7200 | 10008 | GA | Inventive Example |
| 14 | C | 900 | 50 | 5.0 | 1.5 | 1 | 25 | 200 | 14400 | 9745 | CR | Inventive Example |
| 15 | D | 900 | 150 | 5.0 | 1.5 | 2 | 25 | 220 | 14400 | 10157 | GA | Inventive Example |
| 16 | E | 900 | 150 | 8.0 | 2.0 | 3 | 50 | 270 | 60 | 9894 | GA | Inventive Example |
| 17 | F | 875 | 150 | 5.0 | 1.5 | 3 | 25 | 200 | 7200 | 9602 | GA | Comparative Example |
| 18 | G | 875 | 150 | 5.0 | 1.5 | 3 | 25 | 200 | 7200 | 9602 | GA | Comparative Example |
| 19 | H | 875 | 150 | 5.0 | 1.5 | 3 | 25 | 200 | 7200 | 9602 | GI | Comparative Example |
| 20 | I | 900 | 150 | 5.0 | 1.5 | 3 | 25 | 200 | 7200 | 9602 | GA | Comparative Example |
| 21 | J | 825 | 400 | 8.0 | 1.5 | 3 | 15 | 200 | 3600 | 9460 | GA | Inventive Example |

TABLE 3-continued

| No. | Steel type | Heating temperature [° C.] | Staying time t1 (temperature range T1) [s] | First average cooling rate v1 (temperature range T2) [° C./s] | Second average cooling rate v2 (temperature range T3) [° C./s] | Number of times of bending-unbending processing [times] | Cooling stop temperature [° C.] | Temperature X [° C.] | Retention time Y [s] | Variable part Z of Formula 1 | Type | Remarks |
|---|---|---|---|---|---|---|---|---|---|---|---|---|
| 22 | K | 900 | 150 | 27.0 | 1.5 | 3 | 25 | 200 | 7200 | 9602 | GA | Inventive Example |
| 23 | L | 900 | 150 | 2.0 | 1.5 | 3 | 25 | 200 | 7200 | 9602 | GA | Inventive Example |
| 24 | M | 900 | 150 | 5.0 | 1.5 | 1 | 50 | 230 | 60 | 9166 | GA | Inventive Example |
| 25 | N | 830 | 700 | 5.0 | 1.5 | 1 | 25 | 200 | 72000 | 10075 | GA | Inventive Example |
| 26 | O | 900 | 150 | 5.0 | 1.5 | 1 | 50 | 410 | 5 | 11708 | GA | Inventive Example |
| 27 | P | 875 | 150 | 5.0 | 1.5 | 1 | 25 | 170 | 1800 | 8727 | G | Inventive Example |
| 28 | Q | 875 | 150 | 5.0 | 1.5 | 3 | 25 | 200 | 7200 | 9602 | GA | Inventive Example |
| 29 | R | 900 | 150 | 5.0 | 0.4 | 3 | 80 | 270 | 1200 | 10601 | GA | Inventive Example |
| 30 | S | 900 | 150 | 8.0 | 1.5 | 3 | 25 | 220 | 1800 | 9712 | GA | Inventive Example |
| 31 | T | 900 | 150 | 5.0 | 1.5 | 3 | 100 | 300 | 60 | 10441 | GA | Inventive Example |
| 32 | U | 900 | 150 | 25.0 | 1.5 | 3 | 50 | 350 | 60 | 11352 | GA | Inventive Example |
| 33 | V | 900 | 150 | 5.0 | 1.5 | 1 | 50 | 210 | 60 | 8801 | GA | Inventive Example |
| 34 | W | 900 | 150 | 20.0 | 15.0 | 1 | 50 | 300 | 60 | 10441 | GA | Inventive Example |
| 35 | X | 900 | 150 | 5.0 | 1.5 | 1 | 25 | 140 | 172800 | 8954 | GA | Inventive Example |
| 36 | Y | 875 | 150 | 8.0 | 4.0 | 1 | 25 | 200 | 7200 | 9602 | GI | Inventive Example |
| 37 | Z | 900 | 150 | 10.0 | 1.5 | 1 | 50 | 300 | 60 | 10441 | GA | Inventive Example |
| 38 | AA | 900 | 150 | 5.0 | 1.5 | 3 | 25 | 220 | 36000 | 10353 | GA | Inventive Example |
| 39 | AB | 900 | 150 | 5.0 | 1.5 | 3 | 25 | 220 | 36000 | 10353 | GA | Inventive Example |
| 40 | AC | 900 | 150 | 5.0 | 1.5 | 3 | 25 | 220 | 36000 | 10353 | GA | Inventive Example |
| 41 | AD | 940 | 150 | 20.0 | 5.0 | 3 | 50 | 300 | 60 | 10441 | GA | Inventive Example |
| 42 | A | 925 | 150 | 35.0 | 20.0 | 3 | 50 | 200 | 60 | 8619 | GA | Inventive Example |

TABLE 4

| No. | Steel type | Area ratio [%] Martensite | Area ratio [%] Ferrite | Area ratio [%] Retained austenite | Proportion p [%] | Number density n [×10 metastable carbides/mm$^2$] | YS [MPa] | TS [MPa] | YR [%] | EI [%] | λ [%] | Bendability | Delayed fracture resistance | Remarks |
|---|---|---|---|---|---|---|---|---|---|---|---|---|---|---|
| 1 | A | 94 | 2 | 3 | 40 | 600 | 1310 | 1502 | 87 | 10 | 45 | Excellent | A | Inventive Example |
| 2 | A | 64 | 30 | 2 | 24 | 300 | 798 | 1064 | 75 | 9 | 31 | Excellent | B | Comparative Example |
| 3 | A | 84 | 12 | 3 | 24 | 400 | 1060 | 1495 | 71 | 8 | 18 | Poor | B | Comparative Example |
| 4 | A | 94 | 3 | 1 | 0 | 0 | 1203 | 1505 | 80 | 6 | 34 | Excellent | E | Comparative Example |
| 5 | A | 95 | 2 | 2 | 0 | 0 | 1201 | 1505 | 80 | 9 | 36 | Excellent | E | Comparative Example |
| 6 | A | 88 | 0 | 11 | 12 | 500 | 1003 | 1579 | 64 | 10 | 24 | Excellent | C | Comparative Example |
| 7 | A | 94 | 2 | 3 | 14 | 100 | 1304 | 1512 | 86 | 10 | 43 | Excellent | C | Inventive Example |
| 8 | A | 84 | 3 | 12 | 12 | 400 | 962 | 1549 | 62 | 10 | 27 | Excellent | C | Comparative Example |
| 9 | A | 97 | 0 | 2 | 0 | 0 | 1281 | 1563 | 82 | 10 | 34 | Excellent | E | Comparative Example |

TABLE 4-continued

| No. | Steel type | Area ratio [%] Martensite | Ferrite | Retained austenite | Proportion p [%] | Number density n [×10 metastable carbides/mm$^2$] | YS [MPa] | TS [MPa] | YR [%] | EI [%] | λ [%] | Bendability | Delayed fracture resistance | Remarks |
|---|---|---|---|---|---|---|---|---|---|---|---|---|---|---|
| 10 | A | 93 | 4 | 0 | 0 | 0 | 1032 | 1251 | 82 | 10 | 46 | Excellent | E | Comparative Example |
| 11 | A | 94 | 2 | 3 | 24 | 5 | 1325 | 1487 | 89 | 9 | 54 | Excellent | B | Inventive Example |
| 12 | A | 94 | 2 | 3 | 24 | 600 | 1289 | 1495 | 86 | 8 | 48 | Excellent | B | Inventive Example |
| 13 | B | 94 | 3 | 2 | 52 | 500 | 1292 | 1489 | 87 | 7 | 39 | Excellent | A | Inventive Example |
| 14 | C | 97 | 1 | 1 | 32 | 400 | 1216 | 1498 | 81 | 7 | 35 | Excellent | A | Inventive Example |
| 15 | D | 97 | 0 | 2 | 32 | 800 | 1325 | 1868 | 71 | 6 | 33 | Excellent | A | Inventive Example |
| 16 | E | 84 | 9 | 6 | 30 | 50 | 812 | 1199 | 68 | 14 | 32 | Excellent | A | Inventive Example |
| 17 | F | 42 | 50 | 4 | 28 | 300 | 698 | 945 | 74 | 20 | 32 | Excellent | B | Comparative Example |
| 18 | G | 83 | 14 | 2 | 24 | 700 | 989 | 1234 | 80 | 13 | 19 | Poor | B | Comparative Example |
| 19 | H | 65 | 29 | 5 | 24 | 200 | 890 | 1120 | 79 | 12 | 33 | Excellent | B | Comparative Example |
| 20 | I | 83 | 4 | 12 | 24 | 600 | 952 | 1620 | 59 | 10 | 21 | Excellent | B | Comparative Example |
| 21 | J | 95 | 0 | 4 | 32 | 800 | 1401 | 1789 | 78 | 9 | 34 | Excellent | A | Inventive Example |
| 22 | K | 94 | 2 | 3 | 24 | 20 | 1216 | 1542 | 79 | 7 | 36 | Excellent | B | Inventive Example |
| 23 | L | 92 | 4 | 2 | 24 | 200 | 1029 | 1312 | 78 | 9 | 31 | Excellent | B | Inventive Example |
| 24 | M | 93 | 2 | 3 | 40 | 400 | 1294 | 1517 | 85 | 8 | 40 | Excellent | A | Inventive Example |
| 25 | N | 96 | 0 | 2 | 24 | 100 | 1410 | 1820 | 77 | 7 | 32 | Excellent | B | Inventive Example |
| 26 | O | 96 | 0 | 3 | 4 | 0.8 | 1250 | 1515 | 82 | 6 | 44 | Excellent | D | Inventive Example |
| 27 | P | 92 | 0 | 7 | 12 | 50 | 1263 | 1560 | 81 | 10 | 31 | Excellent | C | Inventive Example |
| 28 | Q | 92 | 3 | 3 | 24 | 400 | 1400 | 2003 | 70 | 6 | 32 | Excellent | B | Inventive Example |
| 29 | R | 92 | 0 | 7 | 22 | 600 | 1249 | 1472 | 85 | 6 | 32 | Excellent | B | Inventive Example |
| 30 | S | 96 | 0 | 3 | 32 | 800 | 1325 | 1820 | 73 | 10 | 35 | Excellent | A | Inventive Example |
| 31 | T | 95 | 0 | 4 | 32 | 500 | 1263 | 1543 | 82 | 7 | 40 | Excellent | A | Inventive Example |
| 32 | U | 87 | 7 | 5 | 22 | 700 | 902 | 1187 | 76 | 7 | 40 | Excellent | B | Inventive Example |
| 33 | V | 91 | 5 | 3 | 8 | 400 | 1241 | 1589 | 78 | 9 | 31 | Excellent | C | Inventive Example |
| 34 | W | 97 | 0 | 2 | 32 | 400 | 1357 | 1768 | 77 | 10 | 35 | Excellent | A | Inventive Example |
| 35 | X | 93 | 3 | 3 | 4 | 0.7 | 1298 | 1560 | 83 | 10 | 38 | Excellent | D | Inventive Example |
| 36 | Y | 96 | 0 | 3 | 32 | 700 | 1354 | 1801 | 75 | 7 | 34 | Excellent | A | Inventive Example |
| 37 | Z | 96 | 2 | 2 | 72 | 800 | 1325 | 1556 | 85 | 8 | 46 | Excellent | A | Inventive Example |
| 38 | AA | 94 | 2 | 3 | 38 | 600 | 1310 | 1502 | 87 | 9 | 42 | Excellent | A | Inventive Example |
| 39 | AB | 94 | 2 | 3 | 36 | 620 | 1298 | 1507 | 86 | 9 | 39 | Excellent | A | Inventive Example |
| 40 | AC | 94 | 2 | 3 | 40 | 470 | 1289 | 1511 | 85 | 9 | 39 | Excellent | A | Inventive Example |
| 41 | AD | 98 | 0 | 2 | 42 | 600 | 1298 | 1512 | 86 | 8 | 37 | Excellent | A | Inventive Example |
| 42 | A | 98 | 0 | 2 | 18 | 150 | 1289 | 1522 | 85 | 8 | 40 | Excellent | C | Inventive Example |

<Summary of Evaluation Results>

As shown in Table 4 above, the steel sheets of Nos. 1, 7, 11 to 16, and 21 to 42 all had a tensile strength of 1180 MPa or more, and were excellent in part strength, stretch flangeability, bendability, and delayed fracture resistance.

When these steel sheets are compared, the evaluation results of the delayed fracture resistance were good in the order of the following (i), (ii), (iii), and (iv):

(i) the proportion p is 2% or more and less than 20%, and the number density n is less than $1\times10^6$ metastable carbides/mm;

(ii) the proportion p is 2% or more and less than 20%, and the number density n is $1\times10^6$ metastable carbides/mm or more;

(iii) the proportion p is 20% or more and less than 30%; and (iv) the proportion p is 30% or more.

In contrast, the steel sheets of Nos. 2 to 6, 8 to 10, and 17 to 20 were insufficient in at least one of tensile strength, part strength, stretch flangeability, bendability, and delayed fracture resistance.

Test Example 2

<Manufacture of Steel Sheet>

Molten steels having component compositions shown in Tables 1 and 2 above (the remaining part consists of Fe and inevitable impurities) were smelted in a converter, and made into steel slabs by a continuous casting method.

Each of the obtained steel slabs was subjected to hot rolling to obtain a hot-rolled steel sheet. Specifically, the steel slab was heated to 1250° C., subjected to rough rolling, subjected to finish rolling at a finish rolling temperature of 900° C., wound up under the condition of 500° C., and then cooled to room temperature to obtain a hot-rolled steel sheet.

The obtained hot-rolled steel sheet was subjected to pickling, subsequently subjected to a softening heat treatment under the condition of 500° C., and then subjected to cold rolling under the condition of a rolling ratio of 50%. Thus, a cold-rolled steel sheet having a sheet thickness of 1.2 mm was obtained.

The obtained cold-rolled steel sheet was subjected to annealing and post-heating under the conditions shown in the following Table 5 to obtain a steel sheet.

A heating time at the heating temperature was 200 s.

Bending-unbending processing was performed in the temperature range T2 and the temperature range T3.

In some examples, before annealing, a metal electroplating treatment was performed as the metal plating treatment (pre-annealing plating treatment) to form an Fe-based metal plated layer or a Ni-based metal plated layer.

"Fe" in the case of forming the Fe-based metal plated layer, "Ni" in the case of forming the Ni-based metal plated layer, and "-" in the case of not performing a metal plating treatment were put in the column of "metal plating treatment" in the following Table 5.

As an electroplating bath, a sulfuric acid bath containing 1.5 mol/L of $Fe^{2+}$ ions or $Ni^{2+}$ ions (bath temperature: 50° C., pH: 2.0) was used.

In the electroplating bath, an electrolytic treatment was performed at a current density of 45 A/dm$^2$ using a cold-rolled steel sheet as a cathode and an iridium oxide electrode as an anode. The deposition amount of the metal plated layer to be formed was controlled by adjusting an energization time.

<<Plating Treatment>>

Some of the cold-rolled steel sheets were subjected to a galvanizing treatment during staying in the temperature range T1 (Ms ° C. or higher and 700° C. or lower) to form plated layers (galvanized layers) on both surfaces. That is, a galvanized steel sheet (GI) was obtained.

In the galvanizing treatment, a galvanizing bath (bath temperature: 470° C.) containing Al in an amount of 0.20 mass % with the remaining part being Zn and inevitable impurities was used.

The deposition amount of the galvanized layer per one surface was about 45 g/m$^2$.

The composition of the galvanized layer thus formed was a composition containing Fe in an amount of 0.1 to 1.0 mass % and Al in an amount of 0.2 to 1.0 mass %, with the remaining part consisting of Fe and inevitable impurities.

Some of the other cold-rolled steel sheets were subjected to a galvannealing treatment during staying in the temperature range T1 (Ms ° C. or higher and 700° C. or lower) to form plated layers (galvannealed layers) on both surfaces. That is, a galvannealed steel sheet (GA) was obtained.

In the galvanizing treatment, a galvanizing bath (bath temperature: 470° C.) containing Al in an amount of 0.14 mass % with the remaining part being Zn and inevitable impurities was used.

The alloying treatment was performed at 550° C.

The deposition amount of the galvannealed layer per one surface was about 45 g/m$^2$.

The composition of the galvannealed layer thus formed was a composition containing Fe in an amount of 7 to 15 mass % and Al in an amount of 0.1 to 1.0 mass %, with the remaining part consisting of Fe and inevitable impurities.

"GI" in the case of forming a galvanized layer, "GA" in the case of forming a galvannealed layer, and "CR" in the case of not forming a plated layer were put in the column of "type" in the following Table 5.

Hereinafter, a galvanized steel sheet (GI) and a galvannealed steel sheet (GA) are also simply referred to as "steel sheet".

<Observation of Microstructure>

For each of the obtained steel sheets, the area ratios of martensite, ferrite, and retained austenite, the proportion (proportion p) of the number of martensite blocks in which metastable carbides were present to the number of martensite blocks, and the number density (number density n) of the metastable carbides in the martensite blocks in which the metastable carbides were present were measured according to the methods described above. The results are shown in the following Table 6.

For the obtained steel sheets, the remaining structures other than martensite, ferrite, and retained austenite were all θ (cementite precipitated in ferrite).

<Deposition Amount of Metal Plated Layer>

The deposition amount of the metal plated layer (Fe-based metal plated layer or Ni-based metal plated layer) was determined according to the above-described method. The results are shown in the following Table 6.

When the metal plating treatment was not performed (that is, no metal plated layer was formed), "-" was put in the column of "deposition amount of metal plated layer" in the following Table 6.

<Physical Properties of Soft Layer>

The thickness of the soft layer, the proportion r (total number of measurement points: 512 points), the standard deviation $\sigma_A$, and the standard deviation $\sigma_B$ were obtained according to the above-described method. The results are shown in the following Table 6.

<Evaluation>

The obtained steel sheet was subjected to a tensile test and a hole expansion test in the same manner as in Test Example 1 to determine yield strength (YS), tensile strength (TS), a yield ratio (YR), total elongation (El), and a hole expansion ratio (λ).

The obtained steel sheet was subjected to a bending test and a delayed fracture test in the same manner as in Test Example 1 to evaluate bendability and delayed fracture resistance.

The results are shown in the following Table 6.

Furthermore, the obtained steel sheets were subjected to tests described below to evaluate various characteristics. The results are shown in the following Table 6.

<<90° Bending Processing and Orthogonal Bending Processing>>

From each of the obtained steel sheets, a test piece T1 of 60 mm×65 mm was collected by shearing processing and end face grinding processing. A 60 mm side of the test piece T1 is a side parallel to the rolling direction (L direction) of the steel sheet, and a 65 mm side of the test piece T1 is a side parallel to the width direction (C direction) of the steel sheet.

The collected test piece T1 was subjected to 90° bending processing and orthogonal bending processing to be described later.

Figure 2A:
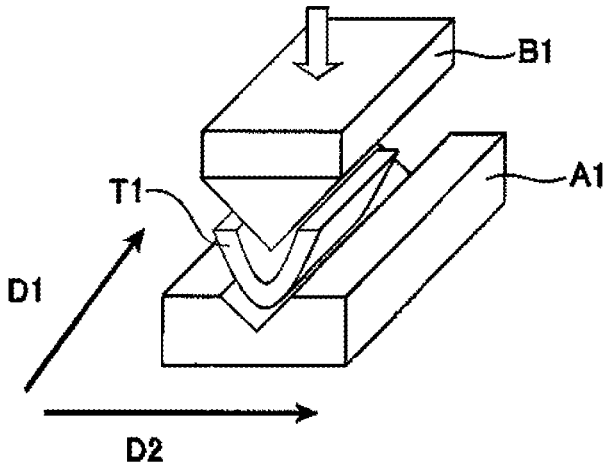
FIG. 2A is a perspective view illustrating a state where a test piece is subjected to 90° bending processing.

FIG. 2A is a perspective view illustrating a state where the test piece T1 is subjected to 90° bending processing.

Figure 2B:
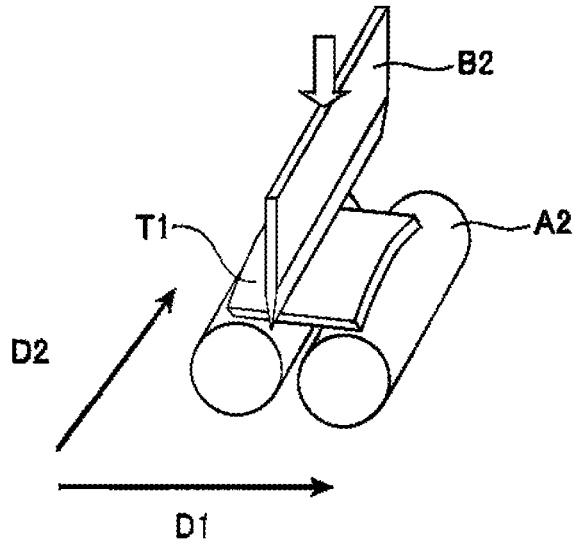
FIG. 2B is a perspective view illustrating a state where a test piece is subjected to orthogonal bending processing.

FIG. 2B is a perspective view illustrating a state where the test piece T1 is subjected to orthogonal bending processing.

In FIGS. 2A and 2B, D1 represents the width direction (C direction), and D2 represents the rolling direction (L direction).

Specifically, first, the test piece T1 was subjected to 90° bending processing (primary bending processing) at a curvature radius/sheet thickness of 4.2. More specifically, as illustrated in FIG. 2A, a punch B1 was pushed into the test piece T1 placed on a die A1 having a V groove under the conditions shown below.

Next, the test piece T1 was subjected to orthogonal bending processing (secondary bending processing). More specifically, as illustrated in FIG. 2B, a punch B2 was pushed into the test piece T1 placed on a support roll A2 under the conditions shown below.

(Conditions of 90° Bending Processing)

Test method: die support, punch pushing

Forming load: 10 tons

Test speed: 30 mm/min

Retention time: 5 s

Bending direction: rolling direction (L direction)

(Conditions of Orthogonal Bending Processing)

Test method: roll support, punch pushing

Roll diameter: φ 30 mm

Punch tip R: 0.4 mm

Distance between rolls: (sheet thickness×2)+0.5 mm

Stroke speed: 20 mm/min

Bending direction: width direction (C direction)

The stroke at the maximum load was obtained from a stroke-load curve obtained when the orthogonal bending processing was performed. The 90° bending processing and the orthogonal bending processing were performed three times, and the average value of three strokes at the maximum load was obtained as $SF_{max}$ (unit: mm).

When the obtained $SF_{max}$ satisfied the following condition A, fracture resistance during collision (resistance to bending fracture) was determined to be excellent.

(Condition A)

$SF_{max}$ is 24.5 mm or more in the case where TS is 1180 MPa or more and less than 1320 MPa, and $SF_{max}$ is 24.0 mm or more in the case where TS is 1320 MPa or more.

<<Axial Crushing Test>>

An axial crushing test was performed as follows.

First, from each of the obtained steel sheets, a test piece of 150 mm×100 mm was collected by shearing processing. A 150 mm side of the test piece is a side parallel to the rolling direction (L direction) of the steel sheet.

Figure 3A:
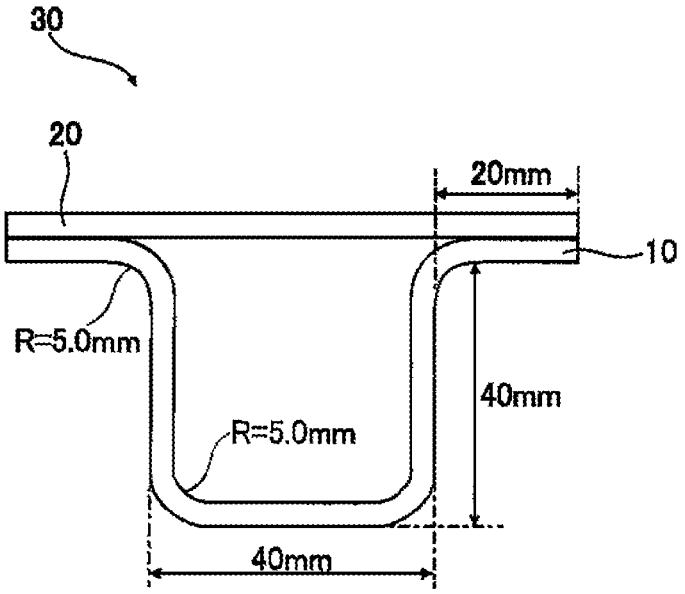
FIG. 3A is a front view of a test body.
Figure 3B:
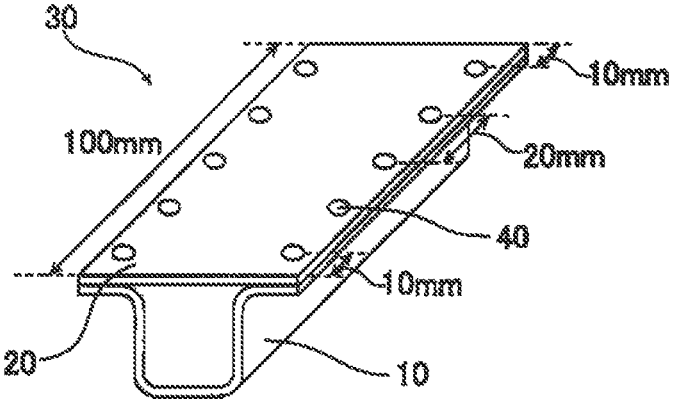
FIG. 3B is a perspective view of a test body.

Next, the test piece was molded (bent) to a depth of 40 mm using a mold having a punch shoulder radius of 5.0 mm and a die shoulder radius of 5.0 mm, thereby producing a hat-shaped member 10 as illustrated in FIGS. 3A and 3B.

A test piece having a size of 80 mm×100 mm was cut out from each of the obtained steel sheets separately from the test piece being the hat-shaped member 10, and used as a flat sheet 20.

The hat-shaped member 10 and the flat sheet 20 were spot-welded to produce a test body 30 as illustrated in FIGS. 3A and 3B.

FIG. 3A is a front view of the test body 30, and FIG. 3B is a perspective view of the test body 30.

As illustrated in FIG. 3B, spot welded portions 40 were positioned so that the distance between an end portion of the test body 30 and the spot welded portion 40 was 10 mm, and the distance between the adjacent spot welded portions 40 was 20 mm.

Figure 3C:
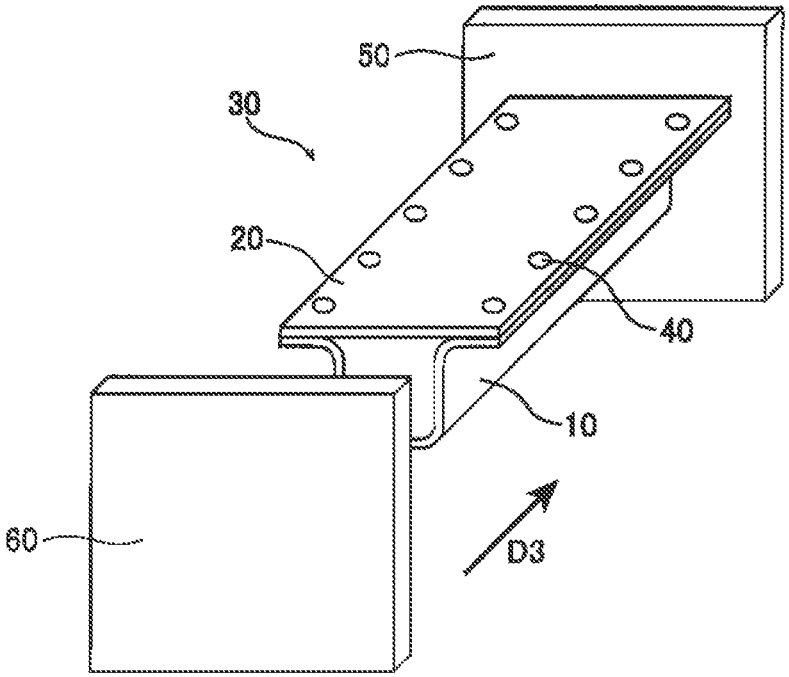
FIG. 3C is a perspective view illustrating a state where a test body is subjected to an axial crush test.

FIG. 3C is a perspective view illustrating a state where the test body 30 is subjected to the axial crushing test.

As illustrated in FIG. 3C, one end portion of the test body 30 was joined to a base sheet 50 by TIG welding. Next, a test (axial crushing test) was performed, in which an impactor 60 collided with the other end portion of the test body 30 at a constant collision speed of 10 mm/min, and the test body 30 was crushed by 70 mm. In FIG. 3C, D3 represents a direction (crushing direction) in which the impactor 60 collides with the test body 30.

The appearance of the test body 30 after the test was observed, and the presence or absence of axial crushing fracture (appearance cracking) was checked.

"A" when no appearance cracking was confirmed, "B" when appearance cracking was confirmed at one or less locations, and "C" when appearance cracking was confirmed at two or more locations are put in the following Table 6. In the case of "A" or "B", fracture resistance during collision (resistance to axial crushing fracture) was determined to be excellent.

TABLE 5

| | | | Annealing | | | | | | | Post-heating | | | | |
|---|---|---|---|---|---|---|---|---|---|---|---|---|---|---|
| No. | Steel type | Meta plating treat-ment | Heating temper-ature [° C.] | Dew point [° C.] | Staying time t1 [s] | First average cooling rate v1 [° C./s] | Second average cooling rate v2 [° C./s] | Number of times of bending-unbending processing [times] | Cooling stop temper-ature [° C.] | Temper-ature X [° C.] | Reten-tion time Y [s] | Variable part Z of Formula 1 | Type | Remarks |
| 43 | A | — | 900 | −25 | 150 | 5.0 | 1.5 | 3 | 25 | 220 | 36000 | 10353 | GA | Inventive Example |
| 44 | A | — | 900 | −15 | 150 | 5.0 | 1.5 | 3 | 25 | 220 | 36000 | 10353 | GA | Inventive Example |
| 45 | A | — | 900 | 10 | 150 | 5.0 | 1.5 | 3 | 25 | 220 | 36000 | 10353 | GA | Inventive Example |
| 46 | A | Fe | 900 | −25 | 150 | 5.0 | 1.5 | 3 | 25 | 220 | 36000 | 10353 | GA | Inventive Example |
| 47 | A | Fe | 900 | −15 | 150 | 5.0 | 1.5 | 3 | 25 | 220 | 36000 | 10353 | GA | Inventive Example |
| 48 | A | Fe | 900 | 10 | 150 | 5.0 | 1.5 | 3 | 25 | 220 | 36000 | 10353 | GA | Inventive Example |
| 49 | A | Ni | 900 | 10 | 150 | 5.0 | 1.5 | 3 | 25 | 220 | 36000 | 10353 | GA | Inventive Example |
| 50 | A | — | 900 | 10 | 150 | 5.0 | 1.5 | 3 | 25 | 220 | 36000 | 10353 | CR | Inventive Example |
| 51 | A | Fe | 900 | −15 | 150 | 5.0 | 1.5 | 3 | 25 | 220 | 36000 | 10353 | CR | Inventive Example |
| 52 | A | Fe | 900 | 10 | 150 | 5.0 | 1.5 | 3 | 25 | 220 | 36000 | 10353 | CR | Inventive Example |
| 53 | A | — | 900 | 10 | 150 | 5.0 | 1.5 | 3 | 25 | 220 | 36000 | 10353 | GI | Inventive Example |
| 54 | A | Fe | 900 | −15 | 150 | 5.0 | 1.5 | 3 | 25 | 220 | 36000 | 10353 | GI | Inventive Example |
| 55 | A | Fe | 900 | 10 | 150 | 5.0 | 1.5 | 3 | 25 | 220 | 36000 | 10353 | GI | Inventive Example |
| 56 | B | — | 900 | −22 | 150 | 4.0 | 1.5 | 2 | 15 | 220 | 7200 | 10008 | GA | Inventive Example |
| 57 | B | — | 900 | −10 | 150 | 4.0 | 1.5 | 2 | 15 | 220 | 7200 | 10008 | GA | Inventive Example |
| 58 | B | — | 900 | 5 | 150 | 4.0 | 1.5 | 2 | 15 | 220 | 7200 | 10008 | GA | Inventive Example |
| 59 | B | Fe | 900 | −22 | 150 | 4.0 | 1.5 | 2 | 15 | 220 | 7200 | 10008 | GA | Inventive Example |
| 60 | B | Fe | 900 | −10 | 150 | 4.0 | 1.5 | 2 | 15 | 220 | 7200 | 10008 | GA | Inventive Example |
| 61 | B | Fe | 900 | 5 | 150 | 4.0 | 1.5 | 2 | 15 | 220 | 7200 | 10008 | GA | Inventive Example |
| 62 | B | Ni | 900 | 5 | 150 | 4.0 | 1.5 | 2 | 15 | 220 | 7200 | 10008 | GA | Inventive Example |
| 63 | B | — | 900 | 5 | 150 | 4.0 | 1.5 | 2 | 15 | 220 | 7200 | 10008 | CR | Inventive Example |
| 64 | B | Fe | 900 | −10 | 150 | 4.0 | 1.5 | 2 | 15 | 220 | 7200 | 10008 | CR | Inventive Example |
| 65 | B | Fe | 900 | 5 | 150 | 4.0 | 1.5 | 2 | 15 | 220 | 7200 | 10008 | CR | Inventive Example |
| 66 | B | — | 900 | 5 | 150 | 4.0 | 1.5 | 2 | 15 | 220 | 7200 | 10008 | GI | Inventive Example |
| 67 | B | Fe | 900 | −10 | 150 | 4.0 | 1.5 | 2 | 15 | 220 | 7200 | 10008 | GI | Inventive Example |
| 68 | B | Fe | 900 | 5 | 150 | 4.0 | 1.5 | 2 | 15 | 220 | 7200 | 10008 | GI | Inventive Example |
| 69 | K | — | 900 | −25 | 150 | 27.0 | 1.5 | 3 | 25 | 200 | 7200 | 9602 | GA | Inventive Example |
| 70 | K | — | 900 | −5 | 150 | 27.0 | 1.5 | 3 | 25 | 200 | 7200 | 9602 | GA | Inventive Example |
| 71 | K | — | 900 | 15 | 150 | 27.0 | 1.5 | 3 | 25 | 200 | 7200 | 9602 | GA | Inventive Example |
| 72 | K | Fe | 900 | −25 | 150 | 27.0 | 1.5 | 3 | 25 | 200 | 7200 | 9602 | GA | Inventive Example |
| 73 | K | Fe | 900 | −5 | 150 | 27.0 | 1.5 | 3 | 25 | 200 | 7200 | 9602 | GA | Inventive Example |
| 74 | K | Fe | 900 | 15 | 150 | 27.0 | 1.5 | 3 | 25 | 200 | 7200 | 9602 | GA | Inventive Example |
| 75 | K | Ni | 900 | 15 | 150 | 27.0 | 1.5 | 3 | 25 | 200 | 7200 | 9602 | GA | Inventive Example |
| 76 | K | — | 900 | 15 | 150 | 27.0 | 1.5 | 3 | 25 | 200 | 7200 | 9602 | CR | Inventive Example |
| 77 | K | Fe | 900 | −5 | 150 | 27.0 | 1.5 | 3 | 25 | 200 | 7200 | 9602 | CR | Inventive Example |

TABLE 5-continued

| No. | Steel type | Meta plating treat-ment | Annealing: Heating temper-ature [° C.] | Annealing: Dew point [° C.] | Annealing: Staying time t1 [s] | Annealing: First average cooling rate v1 [° C./s] | Annealing: Second average cooling rate v2 [° C./s] | Annealing: Number of times of bending-unbending processing [times] | Annealing: Cooling stop temper-ature [° C.] | Post-heating: Temper-ature X [° C.] | Post-heating: Reten-tion time Y [s] | Variable part Z of Formula 1 | Type | Remarks |
|---|---|---|---|---|---|---|---|---|---|---|---|---|---|---|
| 78 | K | Fe | 900 | 15 | 150 | 27.0 | 1.5 | 3 | 25 | 200 | 7200 | 9602 | CR | Inventive Example |
| 79 | K | — | 900 | 15 | 150 | 27.0 | 1.5 | 3 | 25 | 200 | 7200 | 9602 | GI | Inventive Example |
| 80 | K | Fe | 900 | −5 | 150 | 27.0 | 1.5 | 3 | 25 | 200 | 7200 | 9602 | GI | Inventive Example |
| 81 | K | Fe | 900 | 15 | 150 | 27.0 | 1.5 | 3 | 25 | 200 | 7200 | 9602 | GI | Inventive Example |
| 82 | E | — | 900 | −24 | 150 | 8.0 | 2.0 | 3 | 50 | 270 | 60 | 9894 | GA | Inventive Example |
| 83 | E | — | 900 | −12 | 150 | 8.0 | 2.0 | 3 | 50 | 270 | 60 | 9894 | GA | Inventive Example |
| 84 | E | — | 900 | 8 | 150 | 8.0 | 2.0 | 3 | 50 | 270 | 60 | 9894 | GA | Inventive Example |
| 85 | E | Fe | 900 | −24 | 150 | 8.0 | 2.0 | 3 | 50 | 270 | 60 | 9894 | GA | Inventive Example |
| 86 | E | Fe | 900 | −12 | 150 | 8.0 | 2.0 | 3 | 50 | 270 | 60 | 9894 | GA | Inventive Example |
| 87 | E | Fe | 900 | 8 | 150 | 8.0 | 2.0 | 3 | 50 | 270 | 60 | 9894 | GA | Inventive Example |
| 88 | E | Ni | 900 | 8 | 150 | 8.0 | 2.0 | 3 | 50 | 270 | 60 | 9894 | GA | Inventive Example |
| 89 | E | — | 900 | 8 | 150 | 8.0 | 2.0 | 3 | 50 | 270 | 60 | 9894 | CR | Inventive Example |
| 90 | E | Fe | 900 | −12 | 150 | 8.0 | 2.0 | 3 | 50 | 270 | 60 | 9894 | CR | Inventive Example |
| 91 | E | Fe | 900 | 8 | 150 | 8.0 | 2.0 | 3 | 50 | 270 | 60 | 9894 | CR | Inventive Example |
| 92 | E | — | 900 | 8 | 150 | 8.0 | 2.0 | 3 | 50 | 270 | 60 | 9894 | GI | Inventive Example |
| 93 | E | Fe | 900 | −5 | 150 | 8.0 | 2.0 | 3 | 50 | 270 | 60 | 9894 | GI | Inventive Example |
| 94 | E | Fe | 900 | 8 | 150 | 8.0 | 2.0 | 3 | 50 | 270 | 60 | 9894 | GI | Inventive Example |

TABLE 6

| No. | Steel type | Area ratio [%]: Martensite | Area ratio [%]: Ferrite | Area ratio [%]: Retained austenite | Proportion p [%] | Number density n [$\times 10^6$ metastable carbides/mm$^2$] | Deposition amount of metal plated layer [g/m] | Soft layer: Thickness [μm] | Soft layer: Proportion r | Soft layer: Standard deviation $\sigma_A$ [GPa] | Soft layer: Standard deviation $\sigma_B$ [GPa] |
|---|---|---|---|---|---|---|---|---|---|---|---|
| 43 | A | 94 | 2 | 3 | 40 | 600 | — | 7 | 0.18 | 1.9 | 2.3 |
| 44 | A | 94 | 2 | 3 | 40 | 600 | — | 14 | 0.08 | 1.6 | 2.1 |
| 45 | A | 94 | 2 | 3 | 40 | 600 | — | 41 | 0.05 | 1.2 | 1.6 |
| 46 | A | 94 | 2 | 3 | 40 | 600 | 12.0 | 9 | 0.09 | 1.7 | 2.1 |
| 47 | A | 94 | 2 | 3 | 40 | 600 | 12.0 | 18 | 0.07 | 1.3 | 1.5 |
| 48 | A | 94 | 2 | 3 | 40 | 600 | 12.0 | 45 | 0.01 | 0.6 | 0.8 |
| 49 | A | 94 | 2 | 3 | 40 | 600 | 12.0 | 44 | 0.02 | 0.8 | 0.9 |
| 50 | A | 94 | 2 | 3 | 40 | 600 | — | 42 | 0.07 | 1.1 | 1.4 |
| 51 | A | 94 | 2 | 3 | 40 | 600 | 12.0 | 13 | 0.08 | 1.5 | 2.0 |
| 52 | A | 94 | 2 | 3 | 40 | 600 | 12.0 | 43 | 0.02 | 0.6 | 0.9 |
| 53 | A | 94 | 2 | 3 | 40 | 600 | — | 45 | 0.06 | 1.3 | 1.7 |
| 54 | A | 94 | 2 | 3 | 40 | 600 | 12.0 | 16 | 0.07 | 1.7 | 2.0 |
| 55 | A | 94 | 2 | 3 | 40 | 600 | 12.0 | 47 | 0.01 | 0.5 | 0.8 |
| 56 | B | 94 | 3 | 2 | 52 | 500 | — | 5 | 0.20 | 2.0 | 2.3 |
| 57 | B | 94 | 3 | 2 | 52 | 500 | — | 13 | 0.09 | 1.7 | 2.1 |
| 58 | B | 94 | 3 | 2 | 52 | 500 | — | 37 | 0.06 | 1.2 | 1.7 |
| 59 | B | 94 | 3 | 2 | 52 | 500 | 16.0 | 8 | 0.09 | 1.7 | 2.1 |
| 60 | B | 94 | 3 | 2 | 52 | 500 | 16.0 | 17 | 0.08 | 1.4 | 1.6 |
| 61 | B | 94 | 3 | 2 | 52 | 500 | 16.0 | 42 | 0.02 | 0.7 | 0.9 |
| 62 | B | 94 | 3 | 2 | 52 | 500 | 16.0 | 42 | 0.02 | 0.8 | 1.0 |
| 63 | B | 94 | 3 | 2 | 52 | 500 | — | 38 | 0.07 | 1.3 | 1.7 |
| 64 | B | 94 | 3 | 2 | 52 | 500 | 16.0 | 18 | 0.07 | 1.2 | 1.5 |

TABLE 6-continued

| | | | | | | | | | | | |
|---|---|---|---|---|---|---|---|---|---|---|---|
| 65 | B | 94 | 3 | 2 | 52 | 500 | 16.0 | 48 | 0.01 | 0.4 | 0.7 |
| 66 | B | 94 | 3 | 2 | 52 | 500 | — | 40 | 0.06 | 1.1 | 1.6 |
| 67 | B | 94 | 3 | 2 | 52 | 500 | 16.0 | 16 | 0.06 | 1.3 | 1.5 |
| 68 | B | 94 | 3 | 2 | 52 | 500 | 16.0 | 49 | 0.01 | 0.3 | 0.6 |
| 69 | K | 94 | 2 | 3 | 24 | 20 | — | 6 | 0.16 | 1.9 | 2.3 |
| 70 | K | 94 | 2 | 3 | 24 | 20 | — | 22 | 0.07 | 1.5 | 1.9 |
| 71 | K | 94 | 2 | 3 | 24 | 20 | — | 48 | 0.04 | 1.1 | 1.5 |
| 72 | K | 94 | 2 | 3 | 24 | 20 | 10.0 | 10 | 0.08 | 1.4 | 2.1 |
| 73 | K | 94 | 2 | 3 | 24 | 20 | 10.0 | 26 | 0.06 | 1.3 | 1.7 |
| 74 | K | 94 | 2 | 3 | 24 | 20 | 10.0 | 51 | 0.01 | 0.5 | 0.9 |
| 75 | K | 94 | 2 | 3 | 24 | 20 | 10.0 | 49 | 0.01 | 0.6 | 0.8 |
| 76 | K | 94 | 2 | 3 | 24 | 20 | — | 46 | 0.05 | 1.0 | 1.4 |
| 77 | K | 94 | 2 | 3 | 24 | 20 | 10.0 | 23 | 0.06 | 1.2 | 1.6 |
| 78 | K | 94 | 2 | 3 | 24 | 20 | 10.0 | 52 | 0.01 | 0.4 | 0.8 |
| 79 | K | 94 | 2 | 3 | 24 | 20 | — | 44 | 0.04 | 1.1 | 1.5 |
| 80 | K | 94 | 2 | 3 | 24 | 20 | 10.0 | 20 | 0.05 | 1.1 | 1.6 |
| 81 | K | 94 | 2 | 3 | 24 | 20 | 10.0 | 49 | 0.01 | 0.4 | 0.7 |
| 82 | E | 84 | 9 | 6 | 30 | 50 | — | 8 | 0.17 | 1.9 | 2.3 |
| 83 | E | 84 | 9 | 6 | 30 | 50 | — | 16 | 0.08 | 1.5 | 2.0 |
| 84 | E | 84 | 9 | 6 | 30 | 50 | — | 45 | 0.03 | 1.0 | 1.4 |
| 85 | E | 84 | 9 | 6 | 30 | 50 | 11.0 | 10 | 0.09 | 1.7 | 2.1 |
| 86 | E | 84 | 9 | 6 | 30 | 50 | 11.0 | 21 | 0.06 | 1.3 | 1.7 |
| 87 | E | 84 | 9 | 6 | 30 | 50 | 11.0 | 51 | 0.01 | 0.5 | 0.6 |
| 88 | E | 84 | 9 | 6 | 30 | 50 | 11.0 | 53 | 0.01 | 0.4 | 0.5 |
| 89 | E | 84 | 9 | 6 | 30 | 50 | — | 43 | 0.04 | 0.9 | 1.3 |
| 90 | E | 84 | 9 | 6 | 30 | 50 | 11.0 | 18 | 0.07 | 1.2 | 1.6 |
| 91 | E | 84 | 9 | 6 | 30 | 50 | 11.0 | 49 | 0.01 | 0.5 | 0.6 |
| 92 | E | 84 | 9 | 6 | 30 | 50 | — | 49 | 0.04 | 0.8 | 1.2 |
| 93 | E | 84 | 9 | 6 | 30 | 50 | 11.0 | 23 | 0.06 | 1.0 | 1.5 |
| 94 | E | 84 | 9 | 6 | 30 | 50 | 11.0 | 60 | 0.01 | 0.3 | 0.5 |

| No. | YS [MPa] | TS [MPa] | YR [%] | EI [%] | λ [%] | Bendability | Delayed fracture resistance | $SF_{max}$ [mm] | Axial crushing fracture | Remarks |
|---|---|---|---|---|---|---|---|---|---|---|
| 43 | 1310 | 1502 | 87 | 10 | 45 | Excellent | A | 23.6 | B | Inventive Example |
| 44 | 1290 | 1504 | 86 | 8 | 47 | Excellent | A | 24.2 | A | Inventive Example |
| 45 | 1295 | 1510 | 86 | 8 | 42 | Excellent | A | 25.3 | A | Inventive Example |
| 46 | 1305 | 1496 | 87 | 9 | 49 | Excellent | A | 24.2 | A | Inventive Example |
| 47 | 1304 | 1497 | 87 | 8 | 43 | Excellent | A | 25.5 | A | Inventive Example |
| 48 | 1315 | 1496 | 88 | 8 | 46 | Excellent | A | 26.7 | A | Inventive Example |
| 49 | 1306 | 1510 | 87 | 8 | 47 | Excellent | A | 26.5 | A | Inventive Example |
| 50 | 1308 | 1499 | 87 | 9 | 46 | Excellent | A | 25.4 | A | Inventive Example |
| 51 | 1320 | 1500 | 88 | 8 | 46 | Excellent | A | 25.2 | A | Inventive Example |
| 52 | 1302 | 1495 | 87 | 8 | 45 | Excellent | A | 26.9 | A | Inventive Example |
| 53 | 1312 | 1503 | 87 | 9 | 43 | Excellent | A | 26.0 | A | Inventive Example |
| 54 | 1301 | 1498 | 87 | 8 | 46 | Excellent | A | 25.3 | A | Inventive Example |
| 55 | 1304 | 1498 | 87 | 8 | 48 | Excellent | A | 27.2 | A | Inventive Example |
| 56 | 1292 | 1489 | 87 | 7 | 39 | Excellent | A | 23.8 | B | Inventive Example |
| 57 | 1301 | 1488 | 87 | 8 | 38 | Excellent | A | 24.6 | A | Inventive Example |
| 58 | 1298 | 1483 | 88 | 7 | 39 | Excellent | A | 25.7 | A | Inventive Example |
| 59 | 1292 | 1486 | 87 | 7 | 41 | Excellent | A | 24.3 | A | Inventive Example |
| 60 | 1291 | 1491 | 87 | 8 | 37 | Excellent | A | 25.9 | A | Inventive Example |
| 61 | 1301 | 1483 | 88 | 7 | 39 | Excellent | A | 26.8 | A | Inventive Example |
| 62 | 1289 | 1498 | 86 | 7 | 40 | Excellent | A | 26.9 | A | Inventive Example |
| 63 | 1298 | 1491 | 87 | 7 | 42 | Excellent | A | 25.3 | A | Inventive Example |
| 64 | 1297 | 1499 | 87 | 8 | 41 | Excellent | A | 25.5 | A | Inventive Example |
| 65 | 1292 | 1498 | 86 | 8 | 39 | Excellent | A | 27.1 | A | Inventive Example |
| 66 | 1289 | 1491 | 86 | 8 | 37 | Excellent | A | 25.9 | A | Inventive Example |
| 67 | 1294 | 1495 | 87 | 8 | 40 | Excellent | A | 25.6 | A | Inventive Example |
| 68 | 1301 | 1487 | 88 | 7 | 43 | Excellent | A | 27.3 | A | Inventive Example |
| 69 | 1216 | 1542 | 79 | 7 | 36 | Excellent | B | 23.7 | B | Inventive Example |
| 70 | 1220 | 1536 | 79 | 7 | 39 | Excellent | B | 24.5 | A | Inventive Example |
| 71 | 1220 | 1526 | 79 | 8 | 37 | Excellent | B | 25.8 | A | Inventive Example |
| 72 | 1200 | 1531 | 79 | 7 | 38 | Excellent | B | 24.4 | A | Inventive Example |
| 73 | 1218 | 1521 | 79 | 7 | 36 | Excellent | B | 25.7 | A | Inventive Example |
| 74 | 1201 | 1559 | 79 | 8 | 38 | Excellent | B | 26.9 | A | Inventive Example |
| 75 | 1209 | 1558 | 79 | 7 | 39 | Excellent | B | 27.1 | A | Inventive Example |
| 76 | 1220 | 1540 | 79 | 7 | 34 | Excellent | B | 25.8 | A | Inventive Example |
| 77 | 1204 | 1546 | 79 | 8 | 38 | Excellent | B | 25.5 | A | Inventive Example |
| 78 | 1200 | 1536 | 79 | 7 | 39 | Excellent | B | 27.2 | A | Inventive Example |
| 79 | 1202 | 1552 | 79 | 9 | 39 | Excellent | B | 25.9 | A | Inventive Example |
| 80 | 1214 | 1526 | 79 | 7 | 35 | Excellent | B | 25.7 | A | Inventive Example |
| 81 | 1224 | 1555 | 79 | 7 | 40 | Excellent | B | 27.5 | A | Inventive Example |
| 82 | 812 | 1199 | 68 | 14 | 32 | Excellent | A | 24.3 | B | Inventive Example |
| 83 | 812 | 1205 | 67 | 14 | 35 | Excellent | A | 25.9 | A | Inventive Example |
| 84 | 813 | 1209 | 67 | 14 | 34 | Excellent | A | 27.7 | A | Inventive Example |
| 85 | 812 | 1206 | 67 | 14 | 33 | Excellent | A | 25.8 | A | Inventive Example |
| 86 | 823 | 1205 | 68 | 14 | 33 | Excellent | A | 26.8 | A | Inventive Example |
| 87 | 824 | 1200 | 69 | 15 | 33 | Excellent | A | 28.9 | A | Inventive Example |

TABLE 6-continued

| | | | | | | | | | | |
|---|---|---|---|---|---|---|---|---|---|---|
| 88 | 825 | 1198 | 69 | 14 | 35 | Excellent | A | 28.6 | A | Inventive Example |
| 89 | 808 | 1207 | 67 | 15 | 34 | Excellent | A | 27.4 | A | Inventive Example |
| 90 | 809 | 1204 | 67 | 15 | 34 | Excellent | A | 26.0 | A | Inventive Example |
| 91 | 810 | 1204 | 67 | 14 | 35 | Excellent | A | 28.8 | A | Inventive Example |
| 92 | 840 | 1202 | 70 | 14 | 31 | Excellent | A | 27.2 | A | Inventive Example |
| 93 | 830 | 1206 | 69 | 14 | 32 | Excellent | A | 25.8 | A | Inventive Example |
| 94 | 808 | 1206 | 67 | 14 | 36 | Excellent | A | 28.7 | A | Inventive Example |

<Summary of Evaluation Results>

As shown in Table 6 above, the steel sheets of Nos. 43 to 94 all had a tensile strength of 1180 MPa or more, and were excellent in part strength, stretch flangeability, bendability, and delayed fracture resistance. Furthermore, the steel sheets were also excellent in fracture resistance during collision (resistance to axial crushing fracture).

When the dew point was −30° C. or higher and lower than −20° C., the thickness of the soft layer was 10 μm or less. In this case, the evaluation result of the fracture resistance during collision (resistance to axial crushing fracture) by the axial crushing test was "B", but was improved to "A" when having the metal plated layer.

DESCRIPTION OF SYMBOLS

A1 die
A2 support roll
B1 punch
B2 punch
T1 test piece
D1 width direction (C direction)
D2 rolling direction (L direction)
D3 crushing direction
10 hat-shaped member
20 flat sheet
30 test body
40 spot welded portion
50 base sheet
60 impactor

The invention claimed is:

1. A high-strength steel sheet comprising a steel sheet, the steel sheet having: a component composition containing
C in an amount of 0.090 mass % or more and 0.390 mass % or less,
Si in an amount of 0.01 mass % or more and 2.00 mass % or less,
Mn in an amount of 2.00 mass % or more and 4.00 mass % or less,
P in an amount of 0.100 mass % or less,
S in an amount of 0.0200 mass % or less,
Al in an amount of 1.000 mass % or less,
N in an amount of 0.0100 mass % or less, and
O in an amount of 0.0100 mass % or less, with a remaining part containing Fe and inevitable impurities; and a microstructure,
wherein in the microstructure,
an area ratio of martensite is 70% or more,
an area ratio of ferrite is 10% or less,
an area ratio of retained austenite is 10% or less, and
a proportion of the number of martensite blocks in which metastable carbides are present to the number of martensite blocks is 2% or more.

2. The high-strength steel sheet according to claim 1, wherein a number density of the metastable carbides in the martensite blocks in which the metastable carbides are present is $1\times10^6$ metastable carbides/mm$^2$ or more.

3. The high-strength steel sheet according to claim 1, wherein the component composition further contains at least one element selected from the group consisting of
Ti in an amount of 0.200 mass % or less,
Nb in an amount of 0.200 mass % or less,
V in an amount of 0.200 mass % or less,
Ta in an amount of 0.10 mass % or less,
W in an amount of 0.10 mass % or less,
B in an amount of 0.0100 mass % or less,
Cr in an amount of 1.00 mass % or less,
Mo in an amount of 1.00 mass % or less,
Ni in an amount of 1.00 mass % or less,
Co in an amount of 0.010 mass % or less,
Cu in an amount of 1.00 mass % or less,
Sn in an amount of 0.200 mass % or less,
Sb in an amount of 0.200 mass % or less,
Ca in an amount of 0.0100 mass % or less,
Mg in an amount of 0.0100 mass % or less,
REM in an amount of 0.0100 mass % or less,
Zr in an amount of 0.100 mass % or less,
Te in an amount of 0.100 mass % or less,
Hf in an amount of 0.10 mass % or less, and
Bi in an amount of 0.200 mass % or less.

4. The high-strength steel sheet according to claim 1, wherein the steel sheet includes a soft layer in a portion from a surface of the steel sheet to 200 μm in a sheet thickness direction, and
the soft layer is a portion having Vickers hardness of 85% or less with respect to Vickers hardness at a ¼ position of a sheet thickness of the steel sheet.

5. The high-strength steel sheet according to claim 4, wherein when nano-hardness at the ¼ position in depth in the sheet thickness direction of the soft layer is measured at 300 or more points in an area of 50 μm×50 μm, a proportion r of measurement points having nano-hardness of 7.0 GPa or more to a total number of measurement points is 0.10 or less.

6. The high-strength steel sheet according to claim 4, wherein a standard deviation JA of nano-hardness at the ¼ position in depth in the sheet thickness direction of the soft layer is 1.8 GPa or less, and
a standard deviation OB of nano-hardness at a ½ position in depth in the sheet thickness direction of the soft layer is 2.2 GPa or less.

7. The high-strength steel sheet according to claim 1, further comprising a metal plated layer as a pre-annealing plated layer on a surface of the steel sheet.

8. The high-strength steel sheet according to claim 1, further comprising a plated layer on a surface of the steel sheet.

9. The high-strength steel sheet according to claim 7, further comprising a plated layer on a surface of the metal plated layer.

10. A method for manufacturing the high-strength steel sheet according to claim 1, the method comprising:

subjecting a steel slab having the component composition according to claim 1 to hot rolling, pickling, and cold rolling to obtain a cold-rolled steel sheet; and subjecting the cold-rolled steel sheet to annealing and post-heating, wherein in the annealing, the cold-rolled steel sheet is subjected to heating at a heating temperature of 800° C. or higher, and then to cooling to a cooling stop temperature of 150° C. or lower, in the cooling, a staying time t1 in a temperature range T1 of higher than Ms° C. and 700° C. or lower is 1000 s or less, a first average cooling rate v1 in a temperature range T2 of (Ms-80° C.) or higher and Ms° C. or lower is 1.0° C./s or more and 40.0° C./s or less, and a second average cooling rate v2 in a temperature range T3 of 150° C. or higher and lower than (Ms-80° C.) is 0.3° C./s or more and less than the first average cooling rate v1, and the post-heating is performed under a condition that a temperature X that is a maximum end-point temperature and a retention time Y at the temperature X-10° C. or higher satisfy Formula 1:

$$8000 \leq (273 + X) \times (20 + \mathrm{Log}(Y/3600)) \leq 12000, \quad \text{Formula 1}$$

where a unit of the temperature X is ° C., and a unit of the retention time Y is s.

11. The method according to claim 10, wherein the temperature X satisfies Formula 2:

$$100 \leq X \leq 400. \quad \text{Formula 2}$$

12. The method according to claim 10, wherein in the annealing, heating at the heating temperature is performed in an atmosphere having a dew point of −30° C. or higher to form a soft layer in a portion from a surface of the cold-rolled steel sheet to 200 μm in a sheet thickness direction, and the soft layer is a portion having Vickers hardness of 85% or less with respect to Vickers hardness at a ¼ position of a sheet thickness of the cold-rolled steel sheet.

13. The method according to claim 10, wherein before being subjected to the annealing, the cold-rolled steel sheet is subjected to a metal plating treatment to form a metal plated layer as a pre-annealing plated layer on a surface of the cold-rolled steel sheet.

14. The method according to claim 10, wherein in the annealing, the cold-rolled steel sheet is subjected to a plating treatment to form a plated layer.

15. The high-strength steel sheet according to claim 2, wherein the component composition further contains at least one element selected from the group consisting of Ti in an amount of 0.200 mass % or less, Nb in an amount of 0.200 mass % or less, V in an amount of 0.200 mass % or less, Ta in an amount of 0.10 mass % or less, W in an amount of 0.10 mass % or less, B in an amount of 0.0100 mass % or less, Cr in an amount of 1.00 mass % or less, Mo in an amount of 1.00 mass % or less, Ni in an amount of 1.00 mass % or less, Co in an amount of 0.010 mass % or less, Cu in an amount of 1.00 mass % or less, Sn in an amount of 0.200 mass % or less, Sb in an amount of 0.200 mass % or less, Ca in an amount of 0.0100 mass % or less, Mg in an amount of 0.0100 mass % or less, REM in an amount of 0.0100 mass % or less, Zr in an amount of 0.100 mass % or less, Te in an amount of 0.100 mass % or less, Hf in an amount of 0.10 mass % or less, and Bi in an amount of 0.200 mass % or less.

16. The high-strength steel sheet according to claim 3, wherein the steel sheet includes a soft layer in a portion from a surface of the steel sheet to 200 μm in a sheet thickness direction, and the soft layer is a portion having Vickers hardness of 85% or less with respect to Vickers hardness at a ¼ position of a sheet thickness of the steel sheet.

17. The high-strength steel sheet according to claim 16, wherein when nano-hardness at the ¼ position in depth in the sheet thickness direction of the soft layer is measured at 300 or more points in an area of 50 μm×50 μm, a proportion r of measurement points having nano-hardness of 7.0 GPa or more to a total number of measurement points is 0.10 or less.

18. The high-strength steel sheet according to claim 16, wherein a standard deviation $\sigma_A$ of nano-hardness at the ¼ position in depth in the sheet thickness direction of the soft layer is 1.8 GPa or less, and a standard deviation $\sigma_B$ of nano-hardness at a ½ position in depth in the sheet thickness direction of the soft layer is 2.2 GPa or less.

19. The high-strength steel sheet according to claim 3, further comprising a metal plated layer as a pre-annealing plated layer on a surface of the steel sheet.

20. The high-strength steel sheet according to claim 4, further comprising a metal plated layer as a pre-annealing plated layer on a surface of the steel sheet.

21. The high-strength steel sheet according to claim 3, further comprising a plated layer on a surface of the steel sheet.

22. The high-strength steel sheet according to claim 4, further comprising a plated layer on a surface of the steel sheet.

23. The high-strength steel sheet according to claim 19, further comprising a plated layer on a surface of the metal plated layer.

24. The high-strength steel sheet according to claim 20, further comprising a plated layer on a surface of the metal plated layer.

* * * * *